US012055339B2

(12) United States Patent
Baugh et al.

(10) Patent No.: US 12,055,339 B2
(45) **Date of Patent: *Aug. 6, 2024**

(54) SUPPORTING AN ELECTRONIC DISPLAY IN A DISPLAY CASE DOOR

(71) Applicant: Anthony, Inc., Sylmar, CA (US)

(72) Inventors: David Briggs Baugh, Palmdale, CA (US); Pedro Almaguer, North Hills, CA (US); Mark Sandnes, Granada Hills, CA (US)

(73) Assignee: Anthony, Inc., Sylmar (CA)

( * ) Notice: Subject to any disclaimer, the term of this patent is extended or adjusted under 35 U.S.C. 154(b) by 339 days.

This patent is subject to a terminal disclaimer.

(21) Appl. No.: 17/682,992

(22) Filed: Feb. 28, 2022

(65) Prior Publication Data

US 2023/0184485 A1 Jun. 15, 2023

Related U.S. Application Data

(60) Provisional application No. 63/287,930, filed on Dec. 9, 2021.

(51) Int. Cl.
*F25D 23/00* (2006.01)
*A47F 3/00* (2006.01)
(Continued)

(52) U.S. Cl.
CPC ..... *F25D 23/028* (2013.01); *A47F 3/001* (2013.01); *A47F 3/0434* (2013.01); *A47F 11/06* (2013.01);
(Continued)

(58) Field of Classification Search
CPC ..... F25D 23/00; F25D 23/006; F25D 23/02; F25D 23/028; F25D 23/063;
(Continued)

(56) References Cited

U.S. PATENT DOCUMENTS 5,910,083 A * 6/1999 Richardson ..... A47F 3/0434 52/656.1
9,500,402 B2 * 11/2016 Kim ..... F25D 23/02
(Continued)

FOREIGN PATENT DOCUMENTS

CA 3013728 2/2019
CN 209121756 7/2019
(Continued)

OTHER PUBLICATIONS

[No Author Listed], ".093/(2.36) Housings, Plug and Receptacle, 12 CKT, 198/(5.03)CTR," Molex, Nov. 13, 2014, 2 pages.
(Continued)

*Primary Examiner* — Chi Q Nguyen
(74) *Attorney, Agent, or Firm* — Fish & Richardson P.C.

(57) ABSTRACT

A display case door having an insulated panel assembly, a support plate, an electronic display assembly, and a hanger bracket. The insulated panel assembly has a door frame that extends about and is coupled to the insulated panel assembly. The support plate is coupled to a top rail of the door frame and has a least one pin. The electronic display assembly is coupled to the door frame. The hanger bracket is coupled to a top surface of the electronic display assembly and has a slot sized to accept the pin. The electronic display assembly is at least partially supported in the door frame by the support plate and the hanger bracket.

28 Claims, 18 Drawing Sheets

(51) Int. Cl.

| | |
|---|---|
| ***A47F 3/04*** | (2006.01) |
| ***A47F 11/06*** | (2006.01) |
| ***F25D 23/02*** | (2006.01) |
| ***F25D 29/00*** | (2006.01) |

(52) U.S. Cl.
CPC ..... *F25D 29/005* (2013.01); *F25D 2323/02* (2013.01); *F25D 2400/36* (2013.01)

(58) Field of Classification Search
CPC .... F25D 23/064; F25D 23/065; F25D 29/005; F25D 29/00; F25D 2323/02; F25D 2400/36; A47F 3/00; A47F 3/001; A47F 3/005; A47F 3/0434; A47F 3/0426; A47F 3/043; A47F 11/00; A47F 11/06
See application file for complete search history.

(56) References Cited

U.S. PATENT DOCUMENTS

| | | | | |
|---|---|---|---|---|
| 10,174,994 | B2 | 1/2019 | Kim et al. | |
| 10,767,917 | B2 * | 9/2020 | Kim | A47F 3/0434 |
| 10,823,485 | B2 * | 11/2020 | Lv | F25D 23/02 |
| 11,029,075 | B2 * | 6/2021 | Yi | F25D 23/02 |
| 11,047,613 | B1 | 6/2021 | Park et al. | |
| 11,168,937 | B2 * | 11/2021 | Lee | G02B 6/0083 |
| 11,320,192 | B2 | 5/2022 | Lee et al. | |
| 11,402,147 | B2 * | 8/2022 | Lee | F25D 23/02 |
| 11,460,243 | B2 | 10/2022 | Kim et al. | |
| 11,512,895 | B2 * | 11/2022 | Lee | F25D 23/028 |
| 11,768,027 | B2 | 9/2023 | Lee et al. | |
| 11,867,450 | B2 | 1/2024 | Lee et al. | |
| 2012/0169196 | A1 | 7/2012 | Marchetti | |
| 2016/0123654 | A1 | 5/2016 | Lee et al. | |
| 2016/0153221 | A1 | 6/2016 | Dodge et al. | |
| 2017/0176086 | A1 | 6/2017 | Kang | |
| 2018/0292127 | A1 * | 10/2018 | Park | F25D 29/005 |
| 2019/0024962 | A1 * | 1/2019 | Lee | F25C 5/182 |
| 2019/0050900 | A1 | 2/2019 | Avakian | |
| 2019/0122263 | A1 | 4/2019 | Avakian | |
| 2019/0208925 | A1 | 7/2019 | Kim et al. | |
| 2019/0221144 | A1 | 7/2019 | Artwohl et al. | |
| 2020/0256612 | A1 | 8/2020 | Avakian et al. | |
| 2020/0300538 | A1 | 9/2020 | Avakian et al. | |
| 2020/0326119 | A1 * | 10/2020 | Lee | F25D 23/02 |
| 2021/0041161 | A1 | 2/2021 | Avakian | |
| 2021/0366005 | A1 | 11/2021 | Avakian et al. | |
| 2022/0178173 | A1 * | 6/2022 | Arens | E05B 47/0012 |
| 2023/0180948 | A1 | 6/2023 | Almaguer et al. | |
| 2023/0184481 | A1 | 6/2023 | Almaguer et al. | |
| 2023/0225065 | A1 * | 7/2023 | Sandnes | H05K 5/03 49/70 |

FOREIGN PATENT DOCUMENTS

| | | |
|---|---|---|
| WO | WO 2019/032893 | 2/2019 |
| WO | WO 2020/131881 | 6/2020 |
| WO | WO 2021/150406 | 7/2021 |

OTHER PUBLICATIONS

International Preliminary Report on Patentability in International Appln. No. PCT/US2021/036413, dated Dec. 22, 2022, 12 pages.
International Search Report and Written Opinion in International Appln. No. PCT/US2021/036413, dated Oct. 26, 2021, 15 pages.
International Search Report and Written Opinion in International Appln. No. PCT/US2022/081179, dated Mar. 30, 2023, 15 pages.
Invitation to Pay Additional Fees in International Appln. No. PCT/US2021/036413, dated Aug. 17, 2021, 2 pages.
Office Action in Canadian Appln. No. 3,150,495, dated Apr. 12, 2023, 6 pages.
Office Action in Canadian Appln. No. 3,150,502, dated Apr. 12, 2023, 7 pages.
Office Action in Canadian Appln. No. 3,150,511, dated Apr. 11, 2023, 4 pages.

* cited by examiner

SUPPORTING AN ELECTRONIC DISPLAY IN A DISPLAY CASE DOOR

CROSS-REFERENCE TO RELATED APPLICATION

This application claims priority under 35 U.S.C. § 119 to U.S. Provisional Patent Application No. 63/287,930, filed on Dec. 9, 2021, the entire contents of which are hereby incorporated by reference.

TECHNICAL FIELD

This invention relates to thermally insulated doors for temperature-controlled enclosures.

BACKGROUND

Refrigerated enclosures are used in commercial, institutional, and residential applications for storing and/or displaying refrigerated or frozen objects. Refrigerated enclosures can be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures generally include thermally insulated glass panel assemblies.

SUMMARY

The present disclosure relates to a supporting an electronic display assembly in a display case door of a refrigerated enclosure. The electronic display assembly is coupled to the display case door by a support plate with a pin and a hanger bracket with a slot sized to accept the pin. The electronic display assembly is at least partially supported by the support plate and the hanger bracket.

In an example implementation, a display case door includes an insulated panel assembly with a door frame that extends about and coupled to the insulated panel assembly. The display case door includes a support plate coupled to a top rail of the door frame. The support plate has a least one pin. The display case door includes an electronic display assembly coupled to the door frame. The display case door includes a hanger bracket coupled to a top surface of the electronic display assembly. The hanger bracket has a slot sized to accept the pin. The electronic display assembly is at least partially supported in the door frame by the support plate and the hanger bracket.

In an aspect combinable with the example implementation, the display case door has a spacer plate positioned between the support plate and the top rail.

In another aspect combinable with any of the previous aspects, the pin includes an outer rim to couple to a portion of a surface of the hanger bracket.

In another aspect combinable with any of the previous aspects, the hanger bracket supports the electronic display assembly in the door frame such that at least one of multiple side brackets coupled to the electronic display assembly is aligned with at least one of multiple corresponding mounting blocks coupled to the door frame.

In another aspect combinable with any of the previous aspects, the display case door includes multiple fasteners to secure the hanger bracket to the support plate.

In another aspect combinable with any of the previous aspects, the hanger bracket includes two separate hanger brackets horizontally spaced from one another along the top rail of the door frame.

In another aspect combinable with any of the previous aspects, the pin extends from a surface of the support plate.

In another aspect combinable with any of the previous aspects, the support plate includes voids to accept a second set of multiple fasteners to couple the support plate to the top rail.

In another aspect combinable with any of the previous aspects, the hanger bracket includes a first portion and a second portion orthogonally coupled to the first portion. The slot extends through the first portion. The second portion couples the hanger bracket to the electronic display assembly.

In another aspect combinable with any of the previous aspects, the second portion includes multiple apertures sized to accept a third set fasteners to couple the second portion of the hanger bracket to the electronic display assembly.

In another aspect combinable with any of the previous aspects, the electronic display assembly hangs relative to and spaced apart from the insulated panel assembly by the support plate.

In another aspect combinable with any of the previous aspects, the electronic display assembly is uniformly spaced apart from the insulated panel assembly.

In another aspect combinable with any of the previous aspects, a longitudinal axis of the electronic display assembly is aligned to a longitudinal axis of the insulated panel assembly based on the hanger bracket being coupled to the support plate.

In another aspect combinable with any of the previous aspects, an outer dimension of the pin is less than an inner dimension of the slot.

Another aspect combinable with any of the previous aspects, the display case door includes a stiffener bar coupled to the electronic display assembly.

In another example implementation, a display case door hanger assembly includes a support plate and a hanger bracket. The support bracket includes at a least one pin. The support plate couples to a top rail of a door frame of an insulated panel assembly. The hanger bracket has a slot. The hanger bracket couples to an electronic display assembly. The slot is sized to accept the pin. The electronic display assembly is at least partially supported in the door frame by the support plate and the hanger bracket.

An aspect combinable with the example implementation further includes a spacer plate configured to be positioned between the support plate and the top rail.

In another aspect combinable with any of the previous aspects, the pin includes an outer rim to couple to a portion of a surface of the hanger bracket.

An aspect combinable with the example implementation further includes a first set of fasteners to secure the hanger bracket to the support plate.

In another aspect combinable with any of the previous aspects, the hanger bracket includes two separate hanger brackets horizontally spaced from one another along the top rail of the door frame.

In another aspect combinable with any of the previous aspects, the pin extends from a surface of the support plate.

In another aspect combinable with any of the previous aspects, the support plate includes voids to accept a second set of fasteners to couple the support plate to the top rail.

In another aspect combinable with any of the previous aspects, the hanger bracket includes a first portion and a second portion orthogonally coupled to the first portion. The slot extends through the first portion. The second portion couples the hanger bracket to the electronic display assembly.

In another aspect combinable with any of the previous aspects, the second portion includes multiple apertures sized to accept a third set fasteners to couple the second portion of the hanger bracket to the electronic display assembly.

In another aspect combinable with any of the previous aspects, an outer dimension of the pin is less than an inner dimension of the slot.

In another example implementation, a method of installing an electronic display assembly in a display case door including an insulated panel assembly includes coupling a support plate having at least one pin to a top rail of a door frame. The method includes coupling a hanger bracket having a slot to a top surface of the electronic display assembly. The method includes positioning an electronic display in front of the insulated panel assembly of the display case door. The method includes aligning the slot of the hanger bracket to the pin of the support plate. The method includes moving the electronic display toward the insulated panel assembly. The method includes placing the slot of the hanger bracket about the pin of the support plate. The method includes engaging the pin of the support plate to the slot of the hanger bracket. The method includes hanging the electronic display assembly on the door frame.

In an aspect combinable with the example implementation, installing an electronic display assembly in a display case door further includes adjusting a position of the electronic display assembly such that each of one or more side brackets on each side of the electronic display assembly aligns with a corresponding spacer plate inwardly extending from a side rail of the door frame. The method includes securing at least one of the one or more side brackets of the electronic display assembly to a corresponding spacer plate such that the electronic display assembly is at least partially supported in the door frame.

In an aspect combinable with the example implementation, installing an electronic display assembly in a display case door further includes, prior to positioning the electronic display assembly in front of the insulated panel assembly, coupling a stiffener bar to the electronic display assembly.

Particular implementations of the subject matter described in this specification can be implemented so as to realize one or more of the following advantages.

Implementations of the present disclosure can improve the maintainability of electronic displays mounted to a display case door. For example, implementations of the present disclosure can provide for easy replacement or maintenance of electronic displays mounted to a display case door without the need to remove an entire display case door. For example, two people can safely lift and replace the electronic display without placing uneven shear loading on screws and bracket threads.

Implementations of the present disclosure can allow mounting of an electronic display in a display case door without cutouts or notching of the side rails of the door frame, thereby maintaining structural integrity of side rails and increasing manufacturability and interchangeability among different door sizes and display sizes. For example, implementations of the present disclosure can allow the same display to be implemented in different door sizes. In addition, providing an installation without rail cutouts avoids any reduction in strength or rigidity of the supporting structure for the electronic display.

Implementations of the present disclosure can allow for installation of electronic displays of a given size in different size doors using common tools and a common setup.

Implementations of the present disclosure can simplify display case door removal and increase the safety of the operation by using a quick disconnect power connection. Implementations of the present disclosure can allow for the maintenance of cameras or other small electrical components by only one person.

Implementations of the present disclosure can reduce time required for assembly and maintenance of an electronic display assembly. For example, a single person can hang an electronic display assembly on a display case door. For example, an electronic display assembly. For example, a single person can remove the electronic display assembly from the display case door converting it to a clear door assembly. Removing the electronic display assembly from the display case door converting it to a clear door can be used if the electronic display assembly has failed.

Implementations of the present disclosure can improve electronic display assembly durability. For example, positioning stiffeners on the edges of an electronic display assembly during instillation to a display case door can reduce bending, bowing, and warping of electronic display assembly, which can lead to breakage and damage of the electronic display assembly.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
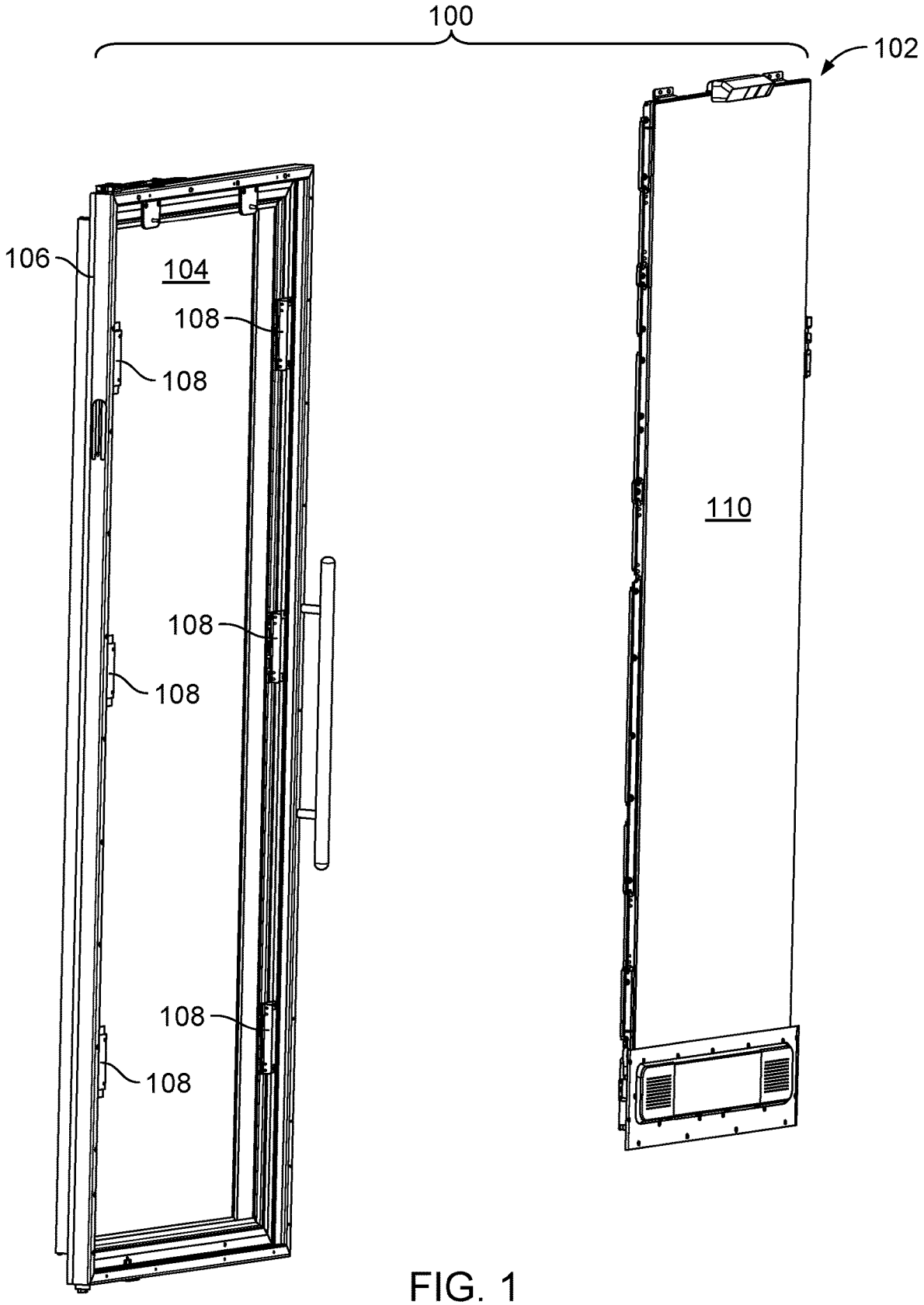
FIG. 1 is an exploded perspective view of an exemplary electronic display case door according to implementations of the present disclosure.

FIG. 1 is an exploded perspective view of an exemplary arrangement of an electronic display assembly 102 in a display case door 100 according to implementations of the present disclosure. FIG. 1 illustrates an exemplary display case door 100 that can be installed in a refrigerated display case such as a refrigerator, a freezer, or other enclosure defining a temperature-controlled space. Display case door 100 includes an insulated panel assembly 104 or transparent panel, a door frame 106 secured to an edge of insulated panel assembly 104, and mounting blocks 108. Mounting blocks are coupled to door frame 106. The display case door 100 include an electronic display assembly 102 that is coupled to door frame 106 by way of mounting blocks 108. Electronic display assembly 102 can be mounted to door frame 106 so as to overlay all or a majority of insulated panel assembly 104. Electronic display assembly 102 can include electronic display 110.

In some implementations, display case door includes one or more bezels (omitted from FIG. 1 for clarity). The bezels can cover all or a portion of the mounting blocks and other components for mounting the electronic display assembly 102.

Insulated panel assembly 104 can include one or more panes of glass. In some implementations, insulated panel assembly 104 includes two or more layers of transparent panes bounding a sealed space in between, forming a sealed glass unit (SGU). Door frame 106 extends around and is secured to a peripheral edge of insulated panel assembly 104. As further described in detail below, door frame 106 defines a channel or tunnel that receives one or more power cables that provide electrical power to the electronic display assembly 102. A portion of the insulated panel assembly 104 can be transparent to visible light so that the electronic display assembly 102 can be viewed through the transparent portion of the insulated panel assembly 104.

Display case door 100 can include a single electronic display 110 or multiple electronic displays. For example, display case door 100 can include two or more electronic displays 110 vertically stacked and together covering the insulated panel assembly 104.

Electronic display 110 can include, but is not limited to, a liquid crystal display (LCD), a light emitting diode (LED) display, an organic light emitting diode (OLED) display, a field emission display (FED), a plasma display panel (PDP), or an electroluminescent (EL) display. For example, electronic display 110 can be a smart television with streaming capabilities for receiving content over a wireless network (e.g., a Wi-Fi network). Electronic display 110 is generally opaque and, when mounted on the display case door 100 partially or completely obstructs the view through the insulated panel assembly 104. In some implementations, electronic display 110 can be a custom sized display configured to correspond with dimensions of the display case door 100. In some implementations, electronic display 110 can be a commercial off the shelf (COTS) display.

Figure 2:
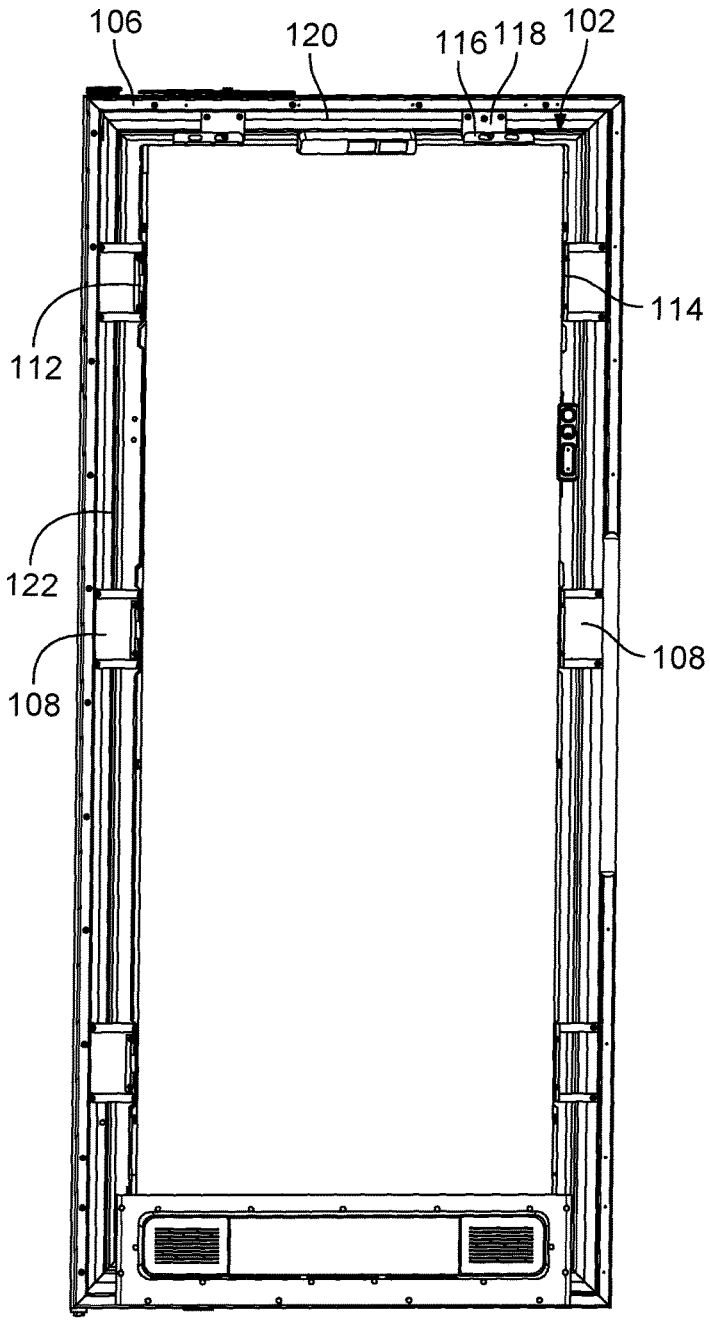
FIG. 2 is a perspective view of the electronic display case door of FIG. 1 with an electronic display mounting a door frame.
Figure 2A:
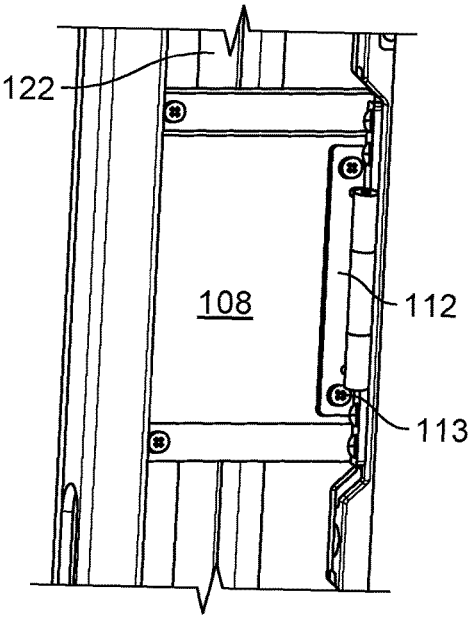
FIGS. 2A and 2B are perspective detail views illustrating mounting of the electronic display assembly.
Figure 2B:
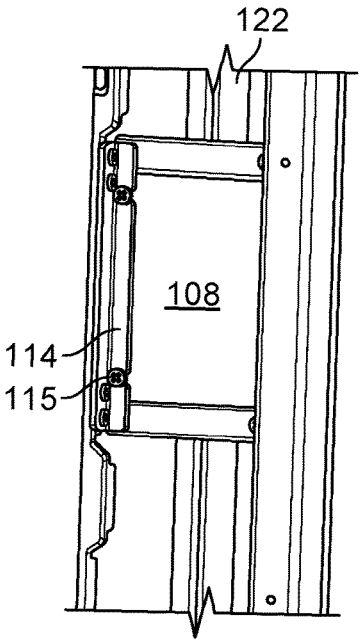

FIG. 2 is a perspective view of the electronic display case door of FIG. 1 with electronic display assembly 102 mounted in door frame 106. FIG. 2A is a perspective detail view illustrating mounting of the electronic display assembly 102 on the left side of the electronic display. FIG. 2B is a perspective detail view illustrating mounting of the electronic display assembly 102 on the right side of the electronic display.

Electronic display assembly 102 includes electronic display 110, left side hinge brackets 112, right side brackets 114, and hangers 116. Left side hinge brackets 112 are attached to electronic display 110 along the left side of electronic display 110. Right side brackets 114 are attached to electronic display 110 along the right side of electronic display 110. Each of left side hinge brackets 112 and right side brackets 114 is secured to a corresponding one of mounting blocks 108 by way of screws 113 and screws 115, respectively. Door frame 106 includes top rail 120 and side rails 122. Electronic display assembly 102 is mounted on mounting blocks 108 on the left side rail 122 of door frame 106 and mounting blocks 108 on the right side rail 122 of door frame 106. Each of hangers 116 can be coupled on a corresponding one of display supports 118.

In the example shown in FIG. 2, electronic display assembly 102 includes three left side hinge brackets 112 and three right side brackets 114. In other examples, an electronic display is secured to a door frame with fewer or more than three brackets and/or corresponding mounting blocks coupled to a door frame. In one example, an electronic display is coupled by way of only one bracket and a corresponding mounting block on each side of the electronic display.

Figure 3:
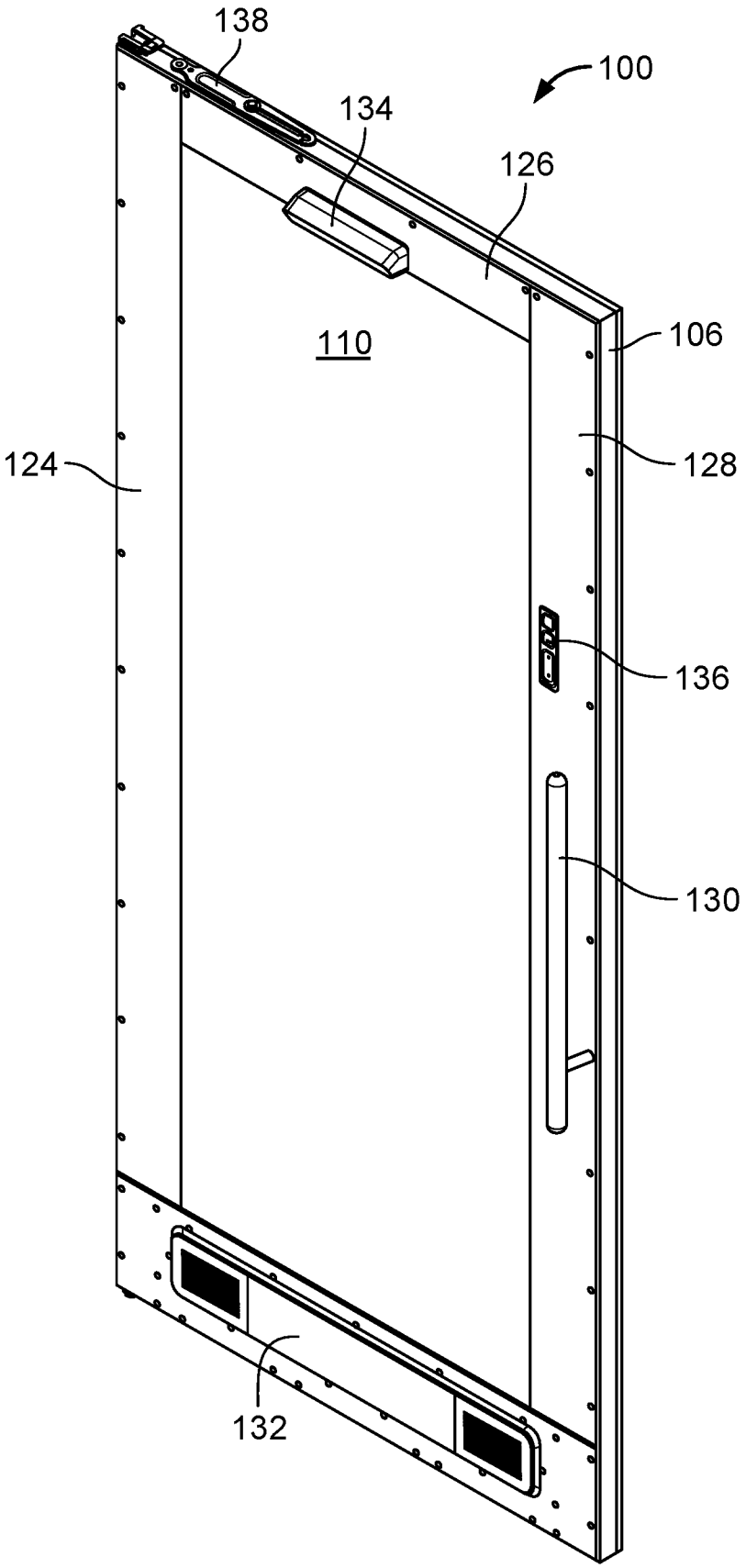
FIG. 3 is a perspective view of the electronic display case door of FIG. 1 with electronic display assembly mounted in door frame with bezels installed.

FIG. 3 is a perspective view of the electronic display case door of FIG. 1 with electronic display assembly 102 mounted in door frame 106, with bezels installed around the edges of door frame 106. Display case door 100 includes left bezel 124, top bezel 126, and right bezel 128. Each of left bezel 124, top bezel 126, and right bezel 128 overlay and conceal a portion of mounting blocks 108, left side hinge brackets 112, right side brackets 114, hangers 116, and display supports 118.

Display case door 100 includes handle 130. Electronic display assembly 102 includes circuitry module 132, top sensor 134, and handle-side sensor 136. The outside edges of circuitry module 132 are secured to left bezel 124 and right bezel 128. Top sensor 134 passes through an opening or cutout in top bezel 126. Handle-side sensor 136 is accessible through a corresponding aperture in right bezel 128.

Hold open bracket 138 is provided on a top edge of display case door 100. One end of hold open bracket 138 is pivotally coupled to door frame 106. In service, hold open bracket 138 can be used to maintain door in a desired open position.

Circuitry module 132 is positioned in a bottom portion of door frame 106. Circuitry module 132 overlays a portion of insulated panel assembly 104. Circuitry module 132 can be attached to electronic display 110 such that, with electronic display 110 releasably coupled to door frame 106, circuitry module 132 is releasably coupled to door frame 106. Circuitry module 132 can include a media player in electronic communication with electronic display 110 to control media content presented on electronic display 110.

Figure 4:
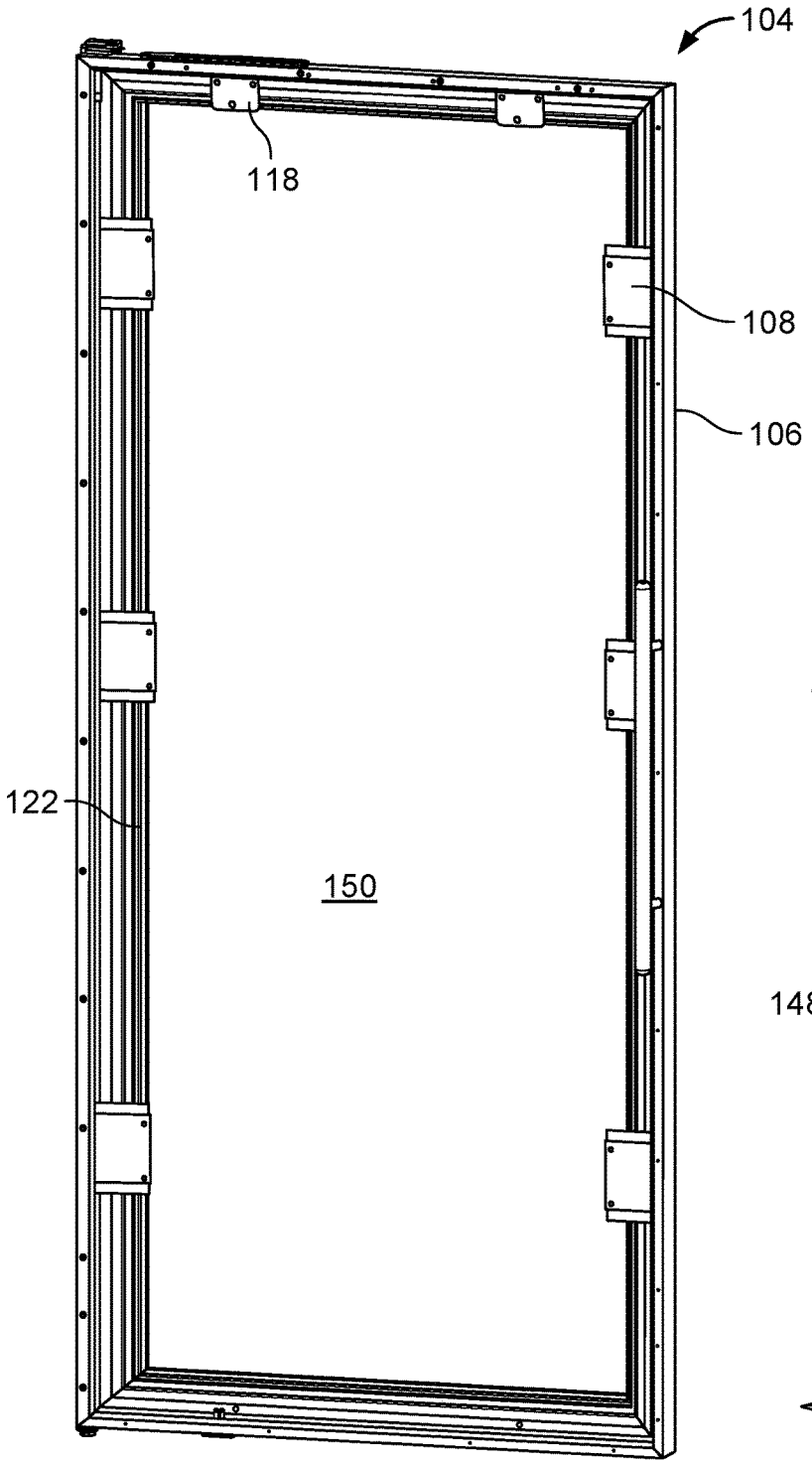
FIG. 4 is a perspective view illustrating a display case door with electronic display assembly removed.
Figure 4A:
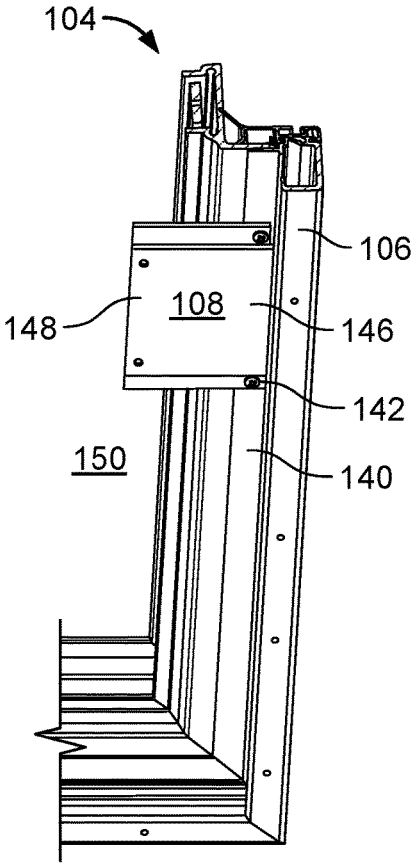
FIG. 4A is a perspective view of a portion of a door frame illustrating installation of a mounting block in a door frame.

FIG. 4 is a perspective view illustrating display case door 100 with electronic display assembly 102 removed. FIG. 4A is a perspective view of a portion of a door frame 106 illustrating one of mounting blocks 108. Mounting block 108 is secured to an inner rim 140 of door frame 106 by way of fasteners 142. Each of mounting blocks 108 extends inwardly from door frame 106. Mounting block 108 is secured to inner rim 140 of door frame 106 by way of fasteners 142 at an outer end 146 of mounting block 108. In some implementations, inner rim 140 includes internally threaded holes for receiving fasteners 142. The internally threaded holes can be in the form of threaded inserts installed at one or more locations on inner rim 140. In some implementations, the internally threaded holes are tapped holes in inner rim 140.

In the example shown in FIG. 4A, mounting block 108 extends inwardly from door frame 106 in front of insulated panel assembly 104. The inside end 148 of mounting block 108 can extend over the glass panels 150 of insulated panel assembly 104.

Figure 5:
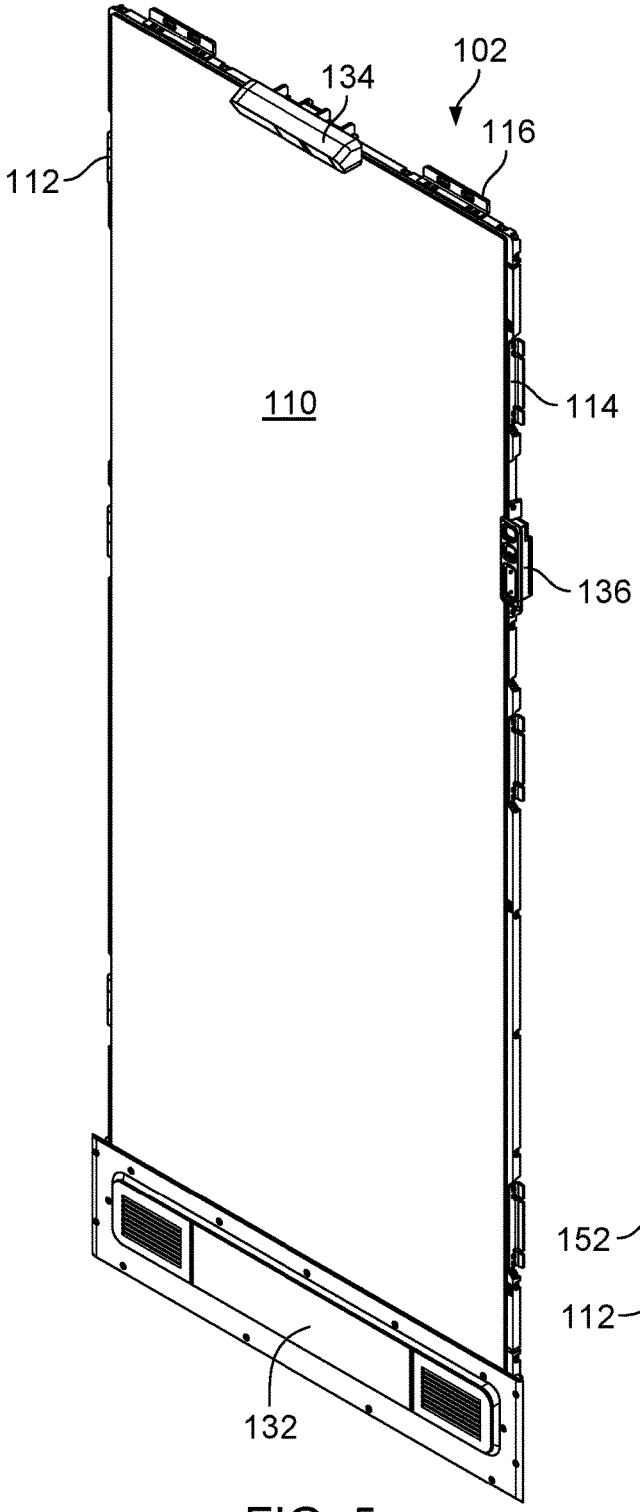
FIG. 5 is a perspective view of the electronic display assembly of FIG. 1.
Figure 5A:
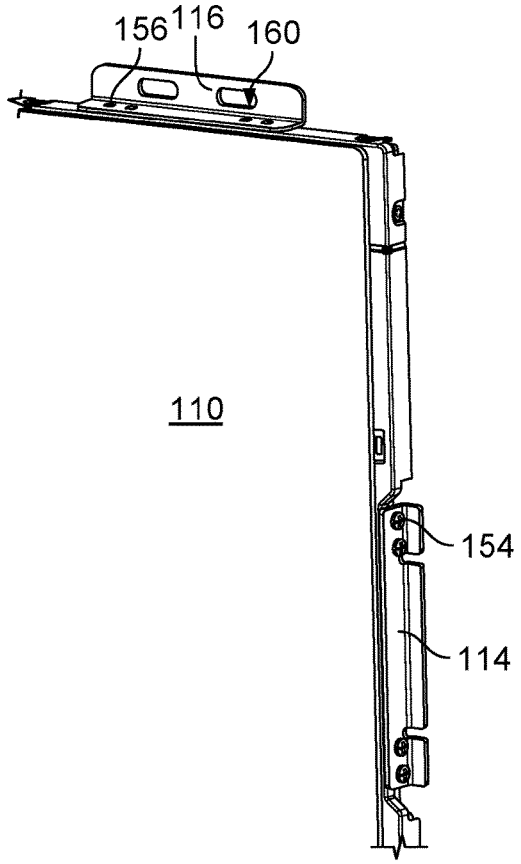
FIGS. 5A and 5B is a perspective detail views of portions illustrating portions of the electronic display assembly.
Figure 5B:
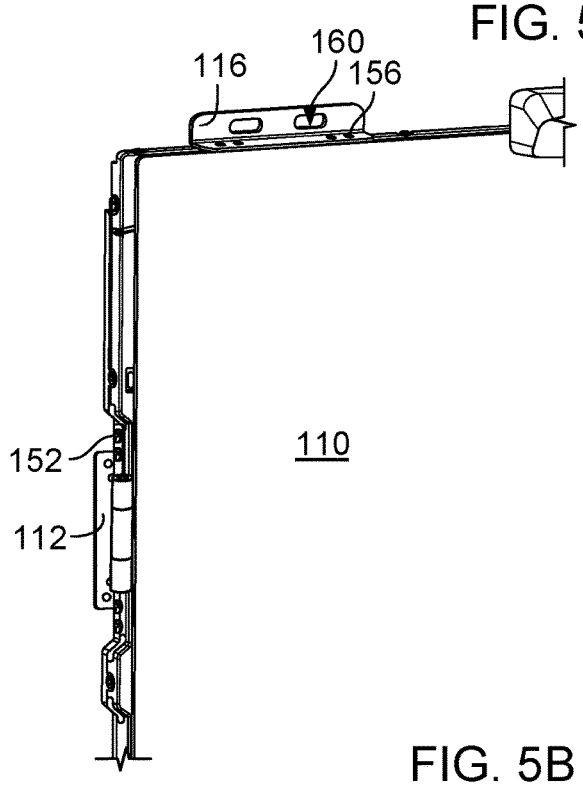

FIG. 5 is a perspective view of the electronic display assembly of FIG. 1. FIG. 5A is a perspective view of the upper right portion of the electronic display assembly. FIG. 5B is a perspective view of the upper left portion of the electronic display assembly. Left side hinge brackets 112 are attached to the left side of electronic display 110 by way of fasteners 152. Right side brackets 114 are attached to the right side of electronic display 110 by way of fasteners 154. Hangers 116 are attached to electronic display 110 by way of fasteners 156. Fasteners 152, 154, and 156 can be screws, bolts, rivets, or another type of fastener. Hangers 116 include slots 160.

Figure 6A:
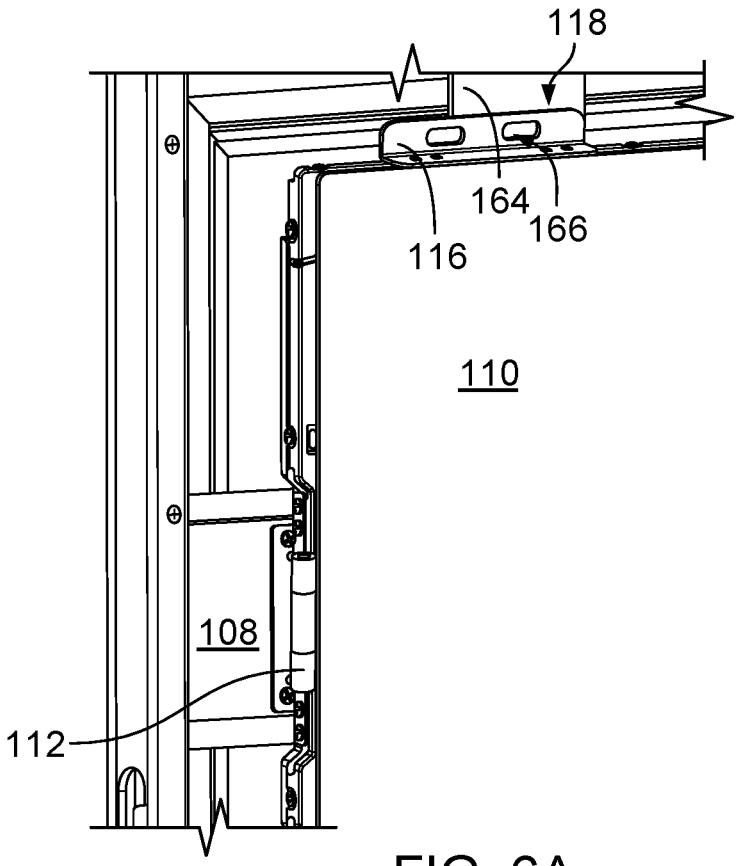
FIGS. 6A and 6B are perspective views of mounting of a left side hinge bracket.
Figure 6B:
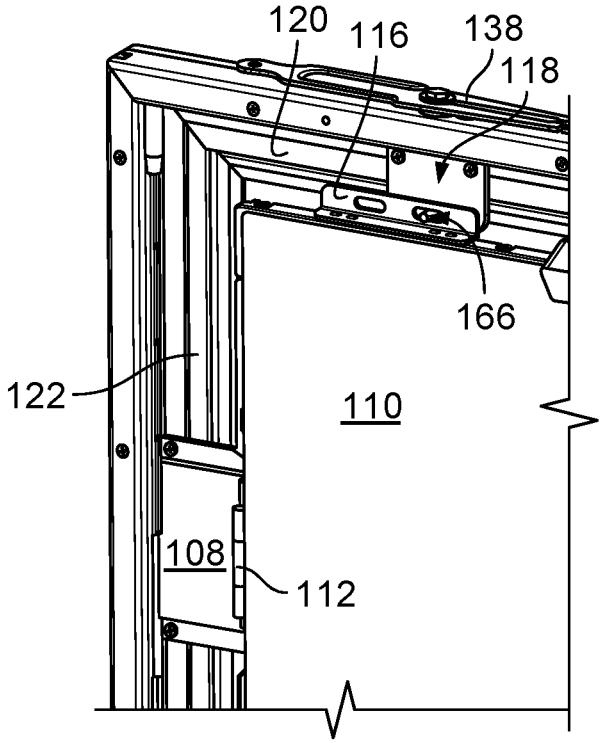

In some implementations, one or more of the mounting blocks serve as a spacer plates. The mounting blocks can define a position of the electronic display relative to a door frame. FIG. 6A is a perspective view of mounting of left side hinge bracket 112 on one of mounting blocks 108 looking inward toward electronic display 110. FIG. 6B is a perspective view of mounting of right side bracket 114 on one of mounting blocks 108 looking outward toward door frame 106. Mounting block 108 is attached to inner rim 140 of insulated panel assembly 104 at outer end 146 of mounting block 108. Left side hinge bracket 112 is secured to inside end 148 of mounting block 108 by way of screws 113. Right side brackets 114 can be secured in a similar manner to that shown in FIGS. 6A and 6B. In one example, screws 113 used to secure left side hinge brackets 112 and screws 115 used to secure right side brackets 114 are #6 pan-head screws.

Along the top edge of electronic display 110, hangers 116 are coupled on display supports 118. In the example shown in FIGS. 5 and 6, there are a pair of hangers spaced across the top edge of electronic display 110.

Display supports 118 include support plate 164 and locating pins 166. Locating pins 166 can pass through slots 160. Display supports 118 are fastened to upper rim 168 of insulated panel assembly 104.

In some implementations, hangers 116 are used to initially support electronic display assembly 102 such that the brackets on either side of electronic display assembly 102 are aligned with corresponding mounting blocks. In this context, aligning the brackets with the mounting blocks 108 includes aligning corresponding features of the brackets and mounting blocks so that one or more fasteners can be installed to secure the electronic display assembly.

Once some or all of the fasteners are installed to secure the brackets of electronic display assembly 102 to corresponding mounting blocks 108, the hangers 116 may no longer be needed to support the electronic display. Thus, in some implementations, hangers 116 serve as an interim support during installation of the electronic display on mounting blocks on the sides of the electronic display. Hangers 116 can be removed after installation of electronic display assembly 102, and re-installed as needed to remove electronic display assembly 102 at a later time. Hangers 116 and display supports 118 are described in more detail later in reference to FIGS. 17A and 17B.

Figure 7:
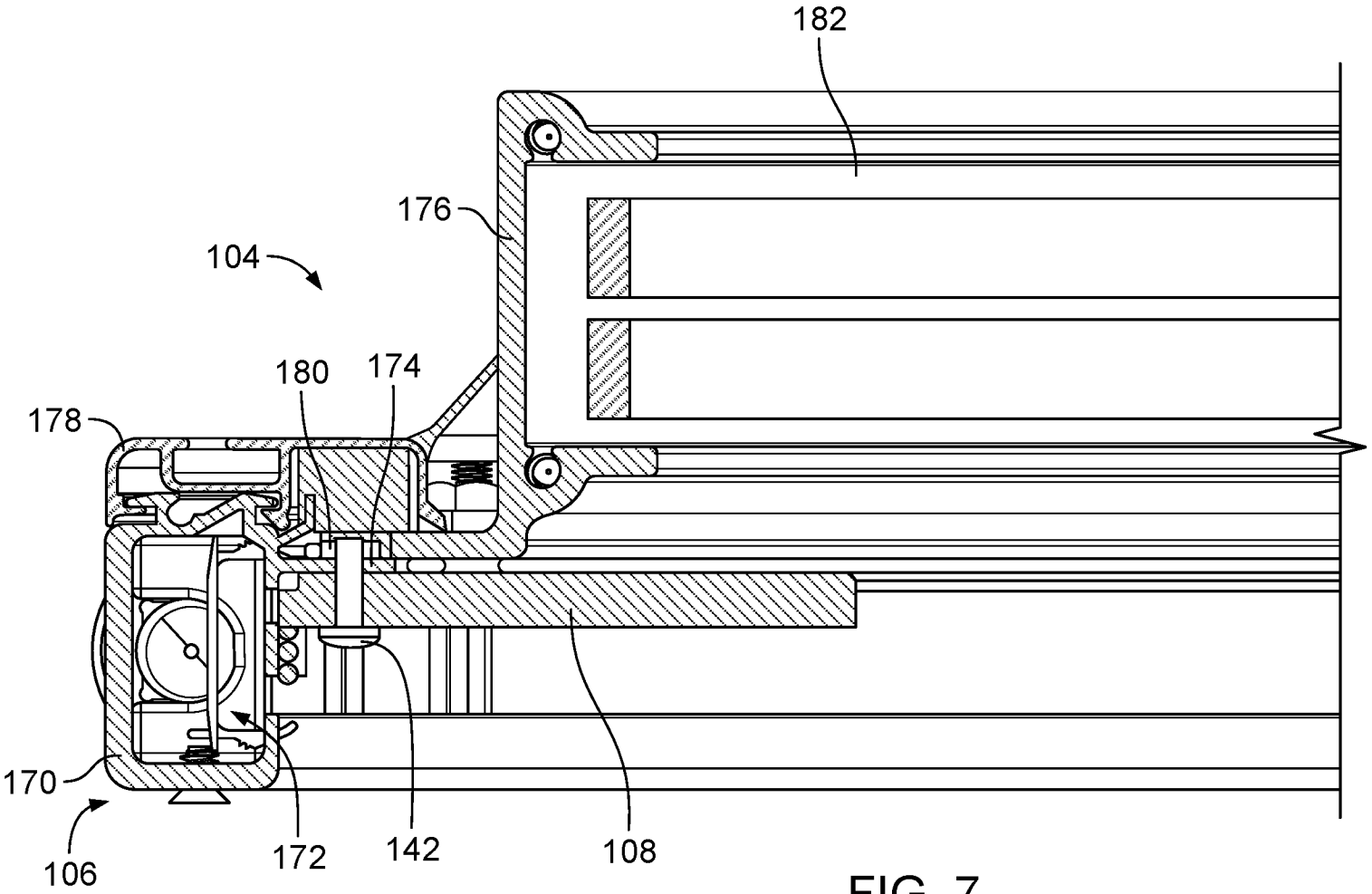
FIG. 7 is a cross sectional view of a mounting block attached to a side door rail on one side of a display case door.

FIG. 7 is a cross sectional view of mounting block 108 attached to a side door rail on one side of a display case door. Door frame 106 includes rail 170. Rail 170 includes channel 172 and inner rim 174. Rail 170 is coupled to subframe member 176. Backing retaining member 178 is secured to rail 170 and subframe member 176. In some implementations, rail 170 is made of an aluminum alloy and subframe member 176 is made of a high-loaded polymer (HLP) material. Subframe member 176 supports and contains glass panels 182.

Inner rim 174 includes bosses 180. Mounting block 108 is secured to rail 170 at bosses 180 by way of fasteners 142. In the example shown in FIGS. 2, 2A, 2B, 6A, and 6B, each mounting block is secured to a rail using two fasteners. One of the fasteners near the top of the mounting block and another near the bottom of the mounting block. Inner rim 174 of rail 170 can extend continuously from top to bottom at the mounting location of mounting block 108.

In some implementations, a side rail of a door frame includes captive nuts at each spacer plate fastener location. Each captive nut can receive a corresponding fastener (e.g., fastener 142). Bosses 180 can be omitted.

In the implementation shown in FIG. 7, fasteners 142 are threaded fasteners. Other types of fasteners can be used. In one example, mounting blocks are fastened to a door frame using rivets.

Figure 8A:
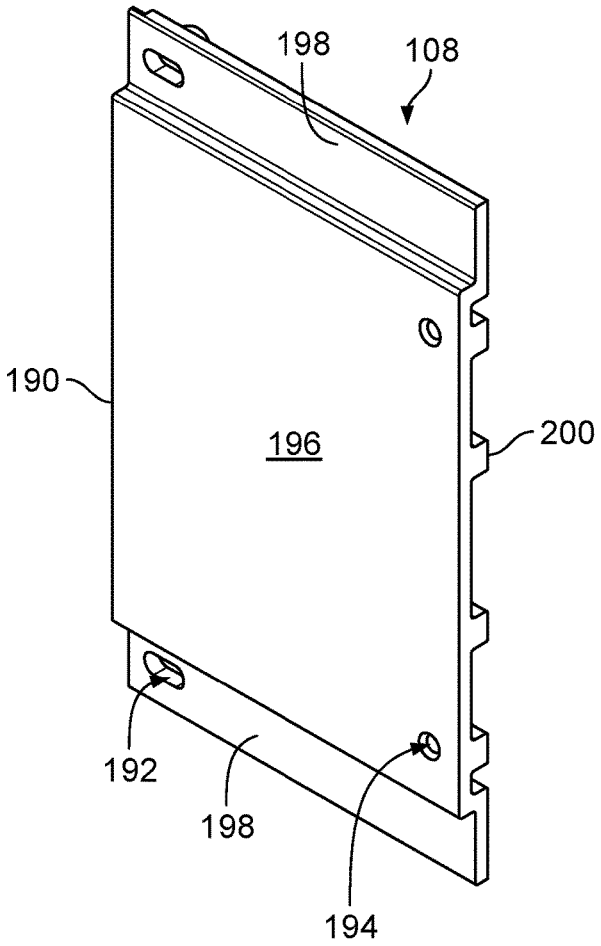
FIG. 8A is a perspective front view of a mounting block according to implementations of the present disclosure.
Figure 8B:
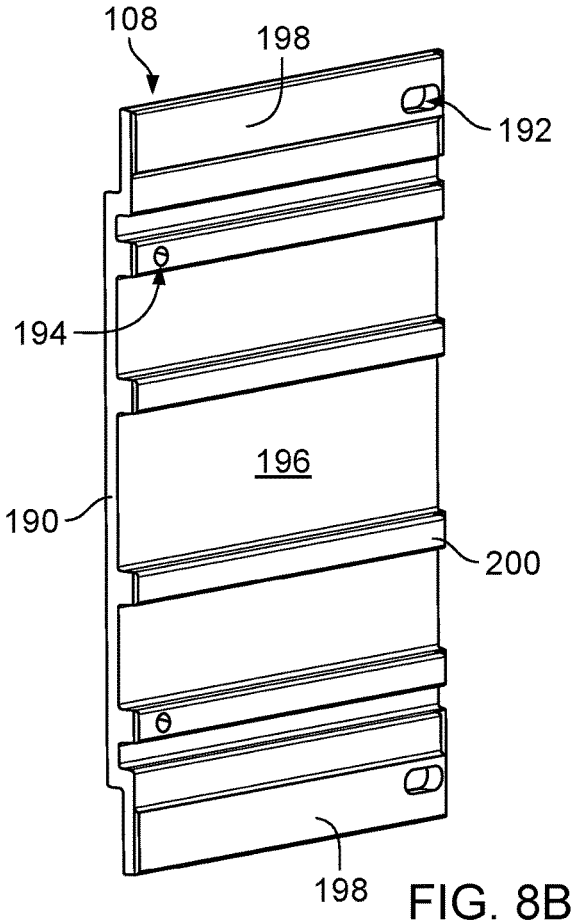
FIG. 8B is a perspective rear view of the mounting block of FIG. 8A.

FIG. 8A is a perspective front view of mounting block 108 according to implementations of the present disclosure. FIG. 8B is a perspective rear view of mounting block 108 of FIG. 8A. Mounting block 108 includes body 190, slots 192, and mounting holes 194. Body 190 includes main plate 196, side rims 198, and ribs 200. Ribs 200 increase the stiffness and strength of mounting block 108. Mounting blocks 108 are made of a material that is stiff enough to support electronic display assembly 102. In one example, mounting blocks 108 are produced from an aluminum extrusion. Examples of other materials for mounting blocks 108 include steel, fiberglass, or a polymer material.

Slots 192 allow for fasteners 142 to pass through for securing mounting block 108 to door frame 106. In one example, mounting blocks 108 are mounted to a door rails glass mount rib. Screws 113 can be installed in mounting holes 194 of mounting blocks 108 to secure each of left side hinge brackets 112 to mounting blocks 108. (In a similar manner, screws 115 can be installed in mounting holes 194 of mounting blocks 108 to secure each of right side brackets 114 to mounting blocks 108.) In some implementations, a mounting includes clearance holes instead of slots 192.

In certain implementations, the internally threaded holes are the form of threaded inserts installed in body 190. In some implementations, the internally threaded holes are tapped holes in body 190. In the example shown in FIGS. 8A and 8B, each of mounting holes 194 passes through one of ribs 200.

In the example shown in FIGS. 8A and 8B, mounting holes 194 are used for attached both left side hinge brackets 112 and right side brackets 114. In other cases, a mounting block can include separate mounting holes for the brackets on either side of an electronic display. The mounting holes for attaching the right and left side brackets can be in-line with one another or offset from one another. A common mounting block part can be used on both sides of the electronic display.

Figure 9A:
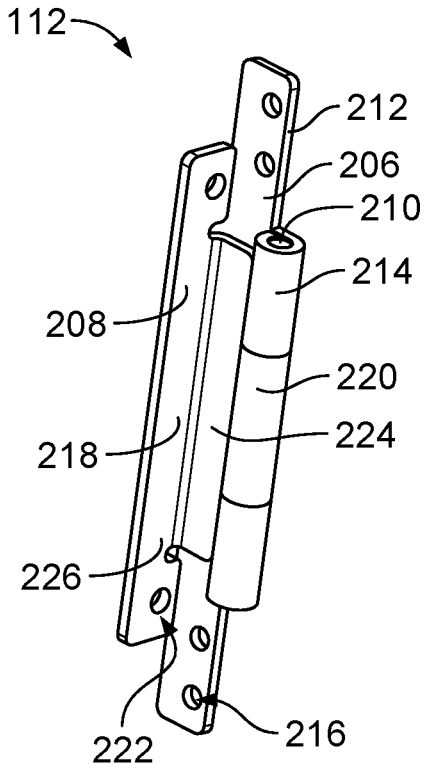
FIG. 9A is a perspective front view of a left side hinge bracket according to implementations of the present disclosure.
Figure 9B:
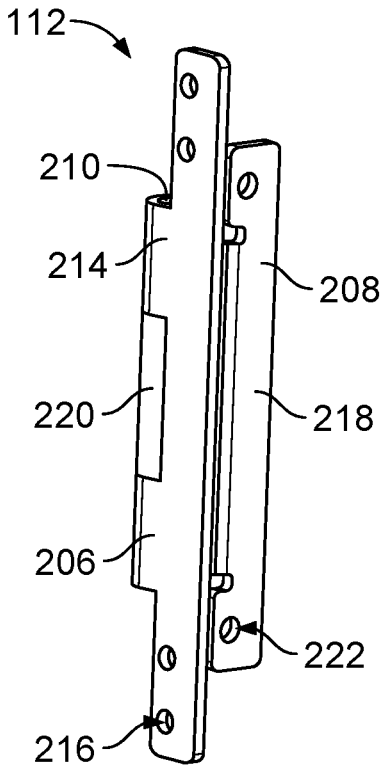
FIG. 9B is a perspective rear view of the left side hinge bracket of FIG. 9A.

FIG. 9A is a perspective front view of left side hinge bracket 112 according to implementations of the present disclosure. FIG. 9B is a perspective rear view of left side hinge bracket 112 of FIG. 9A. Left side hinge bracket 112 includes inside hinge component 206, outside hinge component 208, and hinge pin 210. Inside hinge component 206 includes inside leaf 212, knuckles 214, and mounting holes 216. Outside hinge component 208 includes outside leaf 218, knuckle 220, and mounting holes 222. Outside leaf 218 includes base 224 and leg 226. In this example, base 224 is at a right angle relative to leg 226. Base 224 can contact inside leaf 212 of inside hinge component 206 when electronic display is in installed on door frame 106.

Figure 10A:
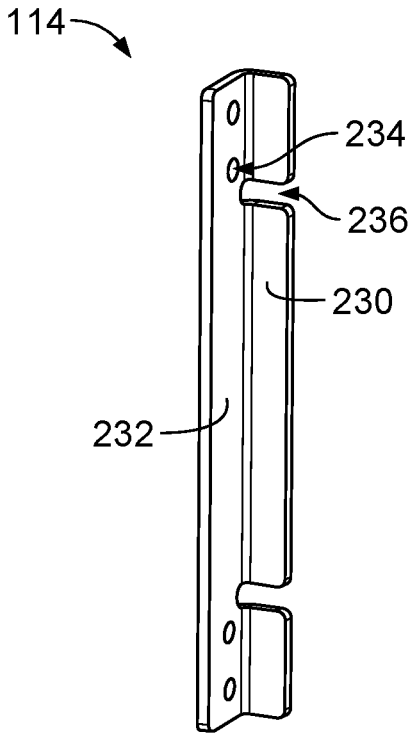
FIG. 10A is a perspective front view of a right side bracket according to implementations of the present disclosure.
Figure 10B:
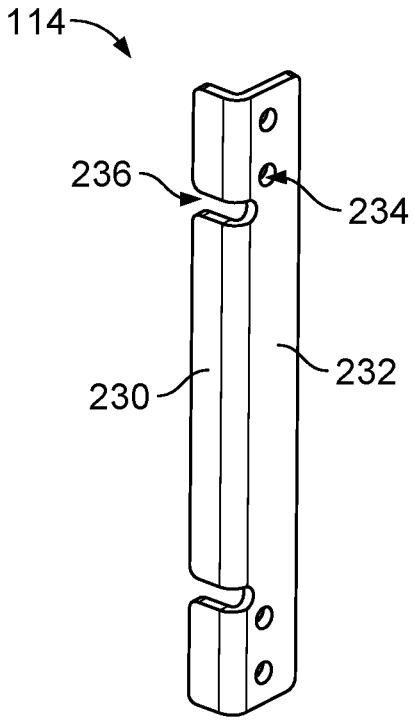
FIG. 10B is a perspective rear view of the right side bracket of FIG. 10A.

FIG. 10A is a perspective front view of right side bracket 114 according to implementations of the present disclosure. FIG. 10B is a perspective rear view of right side bracket 114 of FIG. 9A. In this example, right side bracket 114 is in the form of an "L" shape. Right side bracket 114 includes outside leg 230 and inside leg 232. Outside leg 230 and inside leg 232 are at right angles relative to one another. Inside leg 232 includes mounting holes 234. Outside leg 230 includes slots 236.

To produce electronic display assembly 102, left side hinge brackets 112 are attached to electronic display 110 by installing fasteners 152 through mounting holes 216, and right side brackets 114 are attached to electronic display 110 by installing fasteners 154 through mounting holes 234. Hangers 116 are attached at the top edge of electronic display 110.

In some implementations, mounting hardware installed in door frames accommodates an electronic display of a given size in door frames of different widths and different heights. For example, a system for mounting electronic displays in display case doors can include a set of mounting blocks of different sizes. Each mounting block can serve as a spacer plate that defines the spacing of the electronic display relative to the door frame. The mounting blocks can span a gap between an electronic display assembly and the door frame in which the electronic display assembly is installed. In some implementations, each size of mounting block can accommodate an electronic display of a given size for two or more different size door frames.

In some implementations, the mounting blocks span an inner portion of the door frame and the exterior edge of the electronic display to be installed in the door frame. The mounting blocks define a spacing of the electronic display relative to the door frame. The mounting features of each of the mounting blocks can be aligned with corresponding mounting features of a corresponding bracket on the electronic display assembly. For example, through holes in each bracket of an electronic display assembly can be aligned with corresponding threaded holes in a mounting block. Once the mounting features of the brackets and corresponding mounting blocks are aligned, fasteners can be installed to secure the electronic display assembly to the door frame.

In various examples described herein, an electronic display is centered in a door frame by installing mounting blocks of equal length on either side of the display. In other implementations, the spacer plates on the left and right sides can be of different lengths. In certain implementations, a system can include spacer plates on only one side or the other of an electronic display.

Figure 11C:
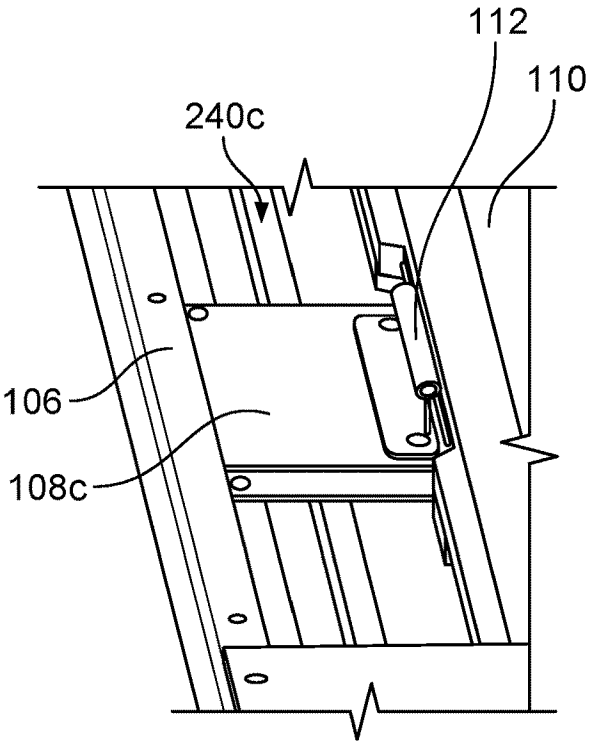
FIGS. 11A, 11B, and 11C illustrate mounting blocks of different sizes according to implementations of the present disclosure.
Figure 11B:
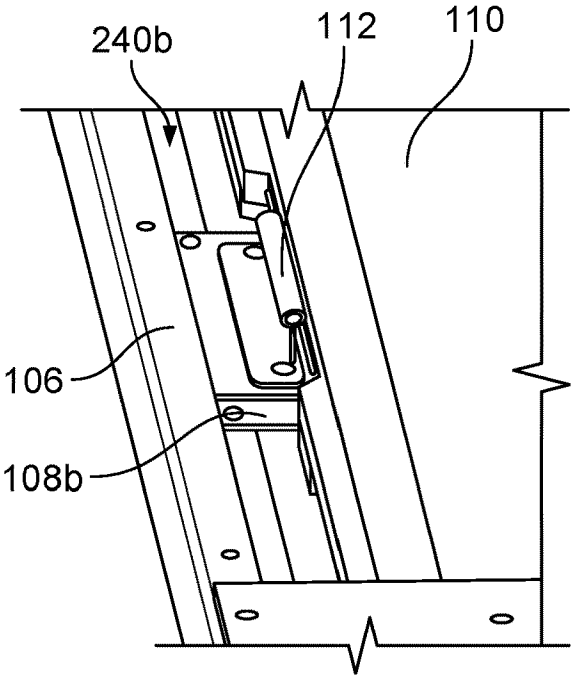
Figure 11A:
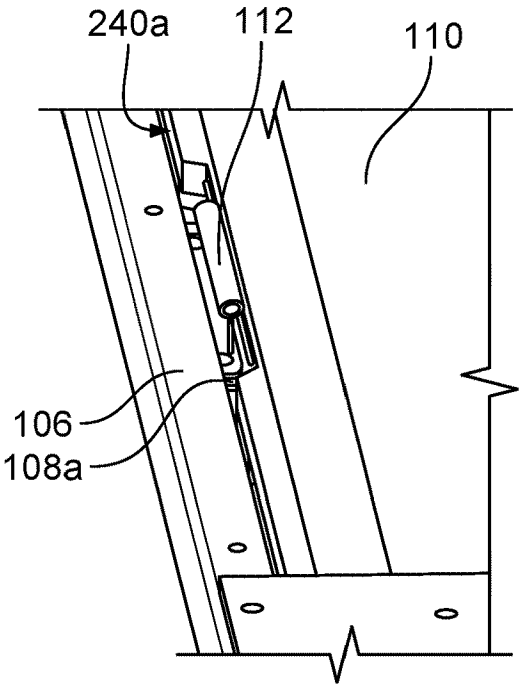

FIGS. 11A, 11B, and 11C illustrate mounting blocks of different sizes. FIG. 11A depicts a mounting block 108*a* that supports a display where there is little or no gap 240*a* between door frame 106 and electronic display 110. FIG. 11B depicts a mounting block 108*b* that extends inwardly from door frame 106 and spans across a gap 240*b* from door frame 106 to electronic display 110. FIG. 11C depicts a mounting block 108*c* that extends inwardly from door frame 106 and spans across a gap 240*c* from door frame 106 to electronic display 110. Each of left side hinge brackets 112 and right side brackets 114 can be coupled to the inner end of any of mounting blocks 108*a*, 108*b*, and 108*c*. In certain implementations, a bracket on an electronic display is attached directly to an inner rim of a door frame, without a mounting block.

In some implementations, all of the mounting blocks in the set (e.g., mounting blocks 108*a*, 108*b*, and 108*c*) are all produced from the same extruded material. Each size of mounting block can be cut to length for the door installation on which it will be used (e.g., based on the spacing between a door frame and the electronic display to be installed in the door frame). In one example, the extruded stock is aluminum. In certain implementations, spacer plates are machined from bar stock.

In some implementations, mounting blocks and support plates are selected to accommodate an electronic display of a given size. Mounting blocks can be selected so that the electronic display is centered horizontally. Display supports can be selected so that mounting brackets on the electronic display are vertically aligned with the mounting blocks on the door frame when the electronic display is hung on the display supports. In this manner, an electronic display of a given size can be installed in doors of several different sizes.

In some implementations, display supports of on a door frame support an electronic display such that the electronic display mounting features of the electronic display vertically align with corresponding mounting features on a door frame when the electronic display is hung on the display supports. In some examples, the length of support brackets and/or the installed height of a locating pin are selected such that mounting blocks on the door frame vertically align with brackets on the electronic display when an electronic display is supported on locating pins of the display supports.

Figure 12C:
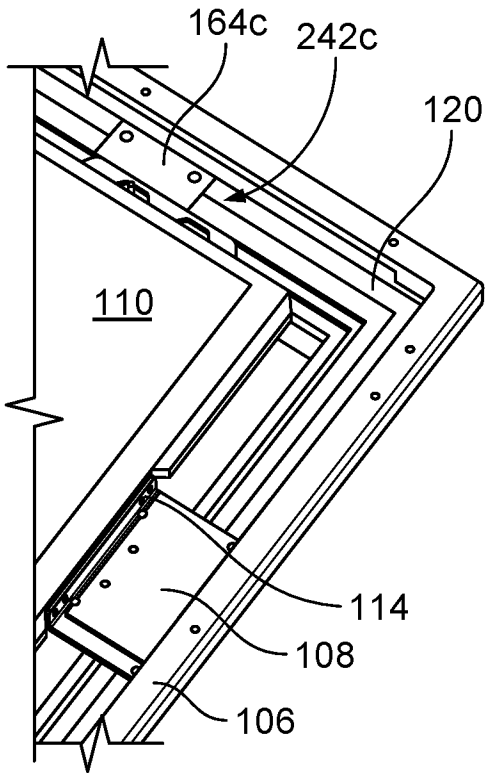
FIGS. 12A, 12B, and 12C illustrate mounting blocks and hanger support plates of different sizes according to implementations of the present disclosure.
Figure 12B:
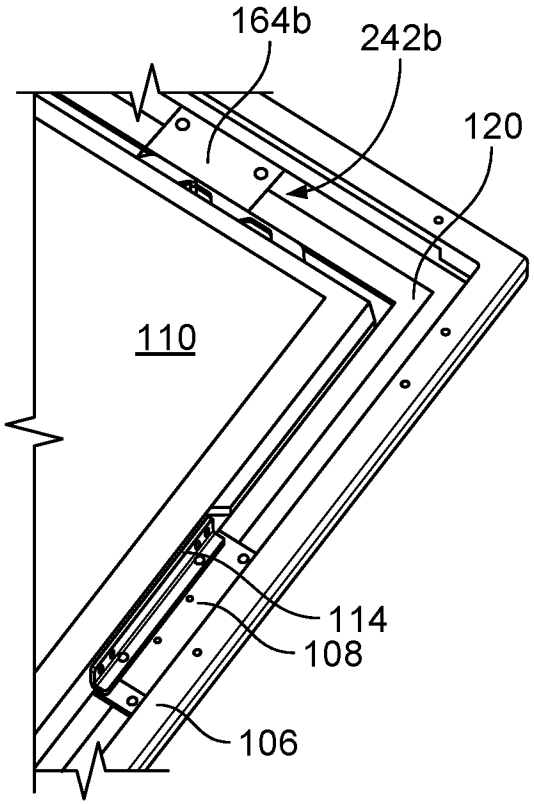
Figure 12A:
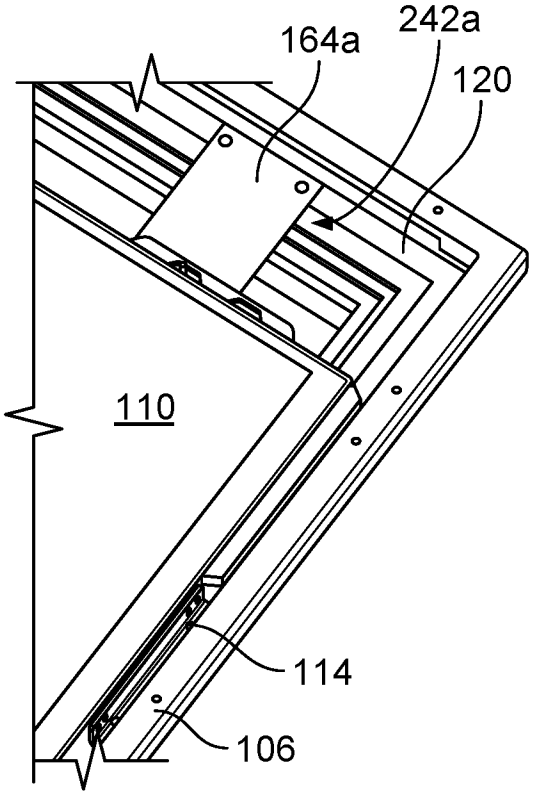

FIGS. 12A, 12B, and 12C illustrate mounting blocks and hanger support plates of different sizes. FIG. 12A depicts a support plate 164*a* that supports electronic display 110 in a door frame of a first size. In this case, there is a relatively large gap 242*a* between top rail 120 of door frame 106 and the top edge of electronic display 110. Hanger 116 hangs on locating pin 166 near the bottom of support plate 164*a*.

FIG. 12B depicts a support plate 164*b* that supports an electronic display 110 in door frame 106 of a second size. In this case, the gap 242*b* between top rail 120 of door frame 106 and the upper edge of electronic display 110 is smaller than that shown in FIG. 12A. Support plate 164*b* supports electronic display 110 closer to top rail 120 of door frame 106 than support plate 164*a*.

FIG. 12C depicts a support plate 164*c* that supports an electronic display 110 in door frame 106 of a third size. In this case, the gap 242*c* between top rail 120 of door frame 106 and the upper edge of electronic display 110 is approximately the same as gap 242*b* shown in FIG. 12B. Thus, support plate 164*c* supports electronic display 110 at about the same distance from top rail 120 of door frame 106 as support plate 164*b*. In the door of FIG. 12C, however, longer mounting blocks 108 are used on the sides of the electronic display to accommodate a narrower electronic display than that shown in FIG. 12B.

In one example, a system include one 64 inch LCD screen that fits door widths that span 26⅜ inches to 30⅞ inches and heights from 69 1/16 inches to 71 1/16 inches. The hinges and brackets are common through the various door sizes. A common space profile can be extruded and cut to length to span the appropriate gap for each installation. In each installation, bezels mount to the door surface, overlap the gap, extend over the screen, and align to the screen's active area perimeter.

In certain implementations, the size of mounting blocks in door system can be selected to accommodate different sizes of an electronic display for a given size door frame. For example, for a given door frame size, opposing left and right pairs of mounting blocks 108*b* shown in FIG. 11B could accommodate a wider electronic display than opposing left and right pairs of mounting blocks 108*c* shown in FIG. 11C.

In some implementations, an electronic display assembly is initially supported on support elements using hangers on the electronic display assembly. While the electronic display assembly is supported on the hangers, the electronic display assembly is fastened to mounting blocks extending from the door frame. In some cases, the position of the electronic display assembly is adjusted while the electronic display assembly is hanging so that mounting features on the electronic display assembly align with corresponding mounting features on the mounting blocks and/or door frame.

Figure 13A:
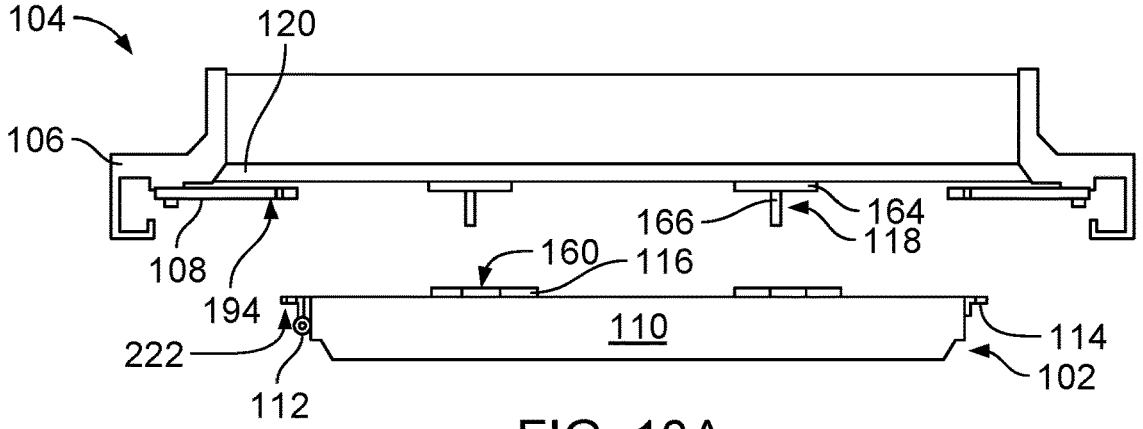
FIGS. 13A-13D are schematic top views of a display door system illustrating installation of an electronic display in a door frame of a display case door.

FIGS. 13A through 13D are schematic top views of a display door system illustrating installation of an electronic display 110 in door frame 106 of display case door. Referring to FIG. 13A, electronic display assembly 102 can be positioned in front of insulated panel assembly 104. Door frame 106 includes a pair of display supports 118 spaced across insulated panel assembly 104 and attached to top rail 120. Each of display supports 118 includes support plate 164 and locating pin 166. In some examples, electronic display assembly 102 is lifted by two persons into position such that slots 160 of hangers 116 are lined up with corresponding locating pins 166 on support brackets 164 attached to top rail 120 of door frame 106.

Figure 13B:
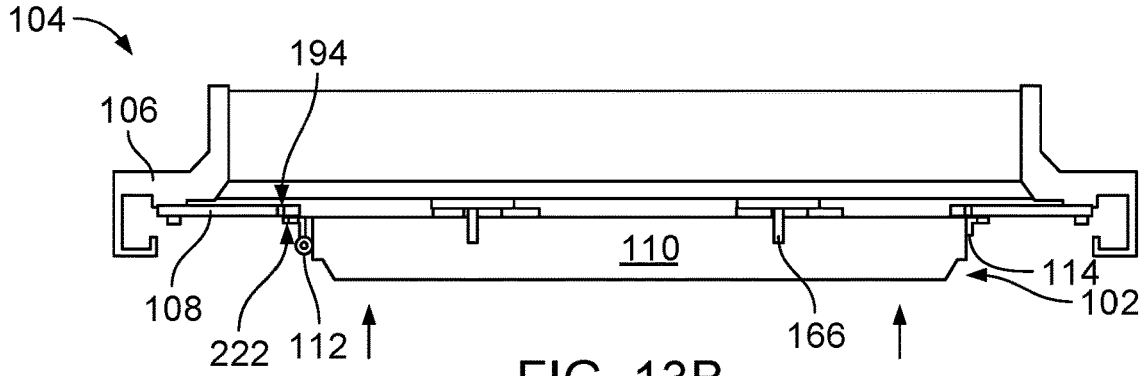

Referring to FIG. 13B, electronic display assembly 102 can be advanced rearwardly toward insulated panel assembly 104 (in the direction of the arrows) until locating pins 166 on support brackets 164 pass through slots 160 of hangers 116 on electronic display assembly 102. In this position, electronic display assembly 102 can be supported on locating pins 166. For illustrative purposes, in FIG. 13B, the mounting features of left side hinge bracket 112 are not aligned with the mounting features of the left mounting block 108.

Figure 13C:
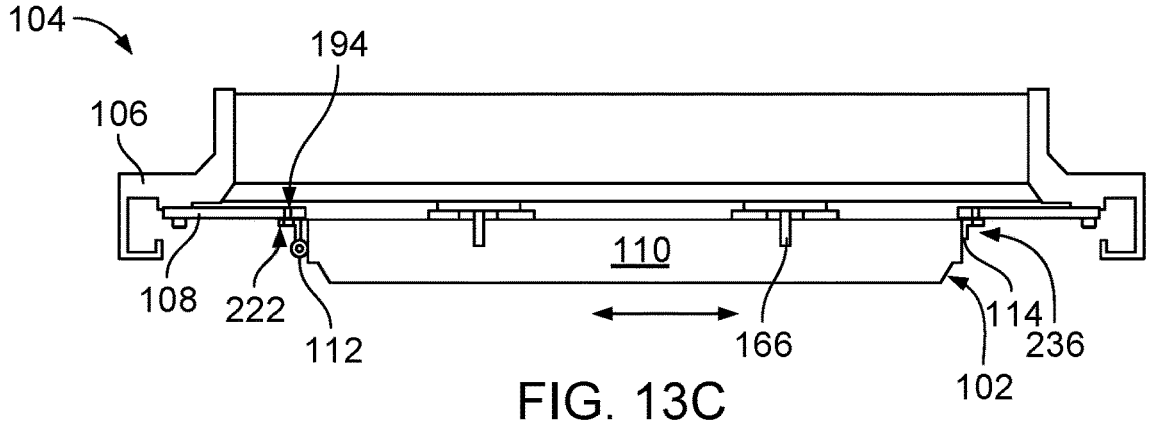

Referring to FIG. 13C, electronic display assembly 102 can be adjusted laterally in either direction (as indicated by the arrows), with slots 160 accommodating movement of locating pins 166 relative to electronic display assembly 102. The lateral position of electronic display assembly 102 can be adjusted until mounting holes 222 of left side hinge brackets 112 align with threaded mounting holes 194 of mounting blocks 108 on the left side of door frame 106. Slots 160 in hangers 116 allow for lateral adjustment of electronic display 110. As the lateral position of electronic display 110 on display supports 118 is adjusted, electronic display assembly 102 continues to be supported on locating pins 166 of display supports 118.

Figure 13D:
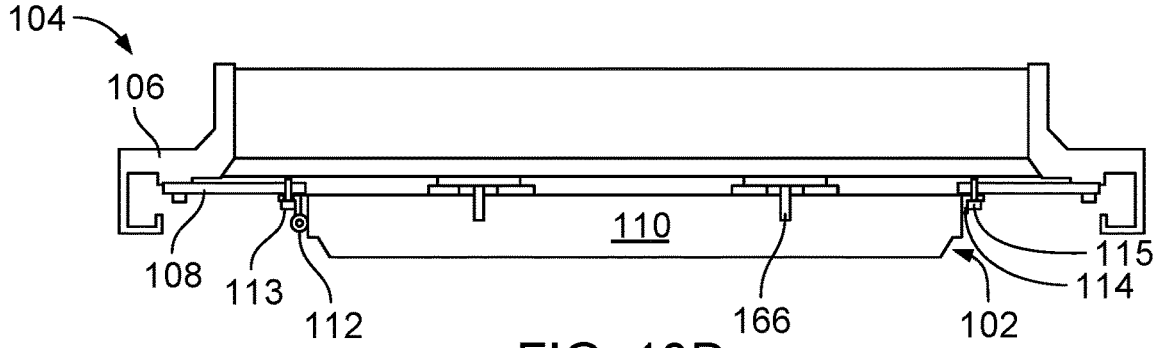

Referring to FIG. 13D, once the lateral position of electronic display assembly 102 has been adjusted to align the mounting features of left side hinge brackets 112 of electronic display assembly 102 and the corresponding mounting features of mounting blocks 108, screws 113 and screws 115 can be installed to secure electronic display assembly 102 to door frame 106. In one example, two screws 113 are installed to secure each of left side hinge brackets 112 on the left side of electronic display assembly 102, and two screws 115 are installed to secure each of right side brackets 114 on the right side of electronic display assembly 102.

Figure 14:
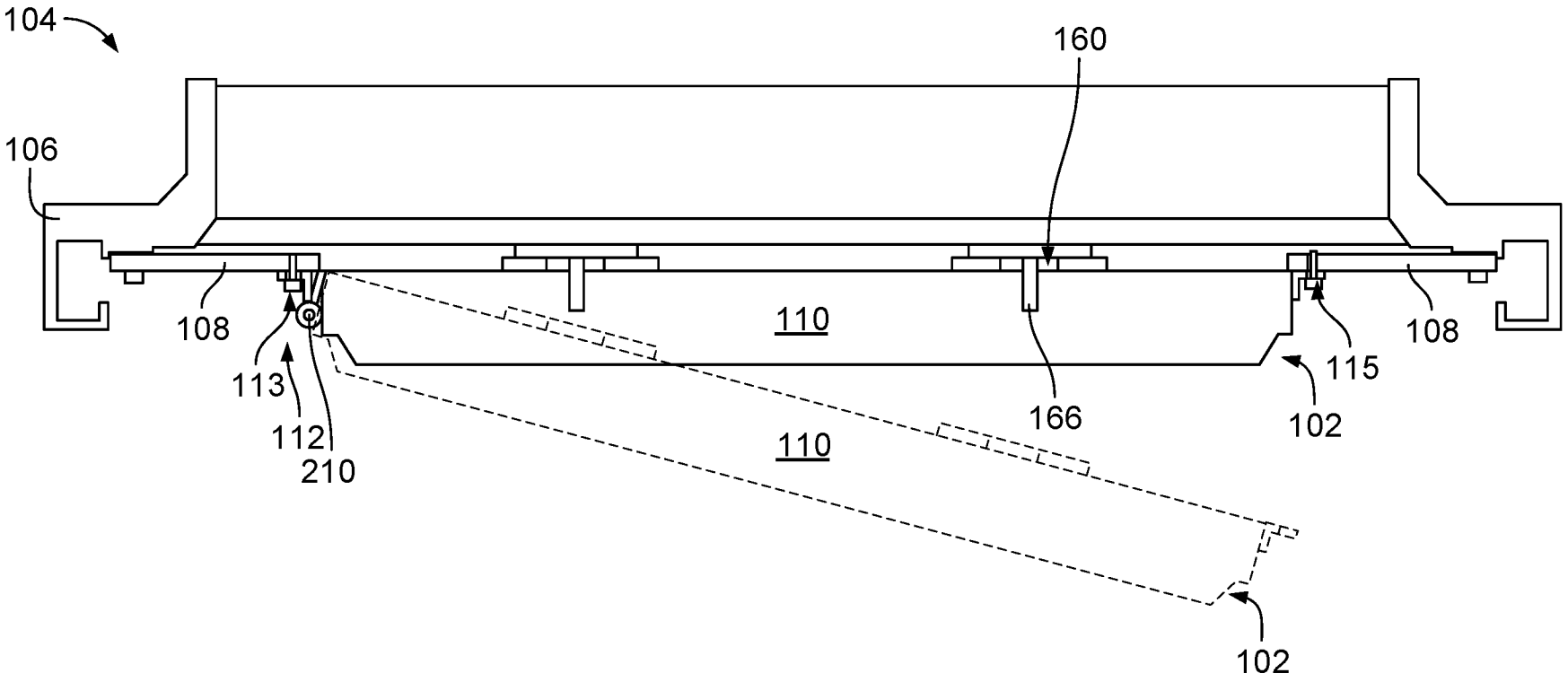
FIG. 14 illustrates swinging an electronic display away from an insulated panel assembly.

In some implementations, electronic display 110 can be swung on right hinge brackets 112, away from glass panels 150 of insulated panel assembly 104 while display case door 100 is in service on a refrigeration system. FIG. 14 illustrates swinging electronic display 110 away from insulated panel assembly 104. Phantom lines show electronic display 110 in the swung-out position. In some implementations, screws 115 for right side bracket 114 are removed to allow the right side of electronic display 110 to be swung back. Screws 113 remain installed to support electronic display 110 on the hinged left side of door frame 106. Swinging electronic display 110 out can allow maintenance personnel to access components on the rear side of electronic display 110 and some components on the front side of insulated panel assembly 104.

In various implementations described above, an electronic display assembly 102 can be hung on display supports 118 and then the electronic display assembly 102 fastened to mounting blocks 108 that have been pre-installed on the sides (e.g., side rails 122) of a door frame 106 (such as shown in FIGS. 13A through 13D). In other implementations, the mounting blocks 108 can be pre-installed on electronic display assembly 102 before the electronic display assembly 102 is hung. Once the electronic display assembly 102 is hung in the door frame 106, the mounting blocks 108 on the electronic display assembly 102 can be fastened to the door frame 106 to secure the electronic display assembly 102.

In certain implementations, an electronic display assembly is removed from an insulated panel assembly by removing the pins from hinge brackets that couple the electronic display assembly to the insulated panel assembly. For example, hinge pins 210 (shown in FIGS. 14, 9A and 9B) can be removed from each of left side hinge brackets 112. Once each of pins 210 has been removed, the inside hinge component 206 and outside hinge component 208 of each of left side hinge brackets 112 can separate from one another so that electronic display 110 is detachable from mounting blocks 108 on the left side of door frame 106. Screws 115 securing right side brackets 114 can be partially or completely removed such that electronic display 110 can be separated from mounting blocks 108 on the right side of door frame 106. In some examples, electronic display 110 remains supported on locating pins 166 of display supports 118 until maintenance personnel lift electronic display 110 away from insulated panel assembly 104.

With the electronic display 110 removed from the insulated panel assembly 104, service can be performed on the electronic display. Once service has been completed, the electronic display 110 can be repositioned such that the knuckles on the hinge components of the left side hinge bracket are realigned with one another. With the knuckles realigned, hinge pins 210 can be reinstalled and screws 115 retightened or replaced to once again secure the electronic display assembly 102 in the door frame.

Referring back to FIG. 3, left bezel 124, top bezel 126, and right bezel 128 are coupled to a front surfaces of door frame 106 or to a front surface of electronic display 110 or both. Each of left bezel 124, top bezel 126, and right bezel 128 are sized to overlay at least a portion of each of a front surface of door frame 106, mounting blocks 108, left side hinge brackets 112, right side brackets 114, and/or support brackets 164. Any or all of left bezel 124, top bezel 126, and right bezel 128 can also overlay the front surface of a housing of electronic display 110. In some implementations, the front surface of electronic display 110 is flush with the front surface of door frame 106. In this case, left bezel 124, top bezel 126, and right bezel 128 can be flat.

In various implementations, door frame 106 has a width and thickness that allows display case door 100 to be installed and operated in an existing refrigerated display case without the need of retrofitting the display case. The display case door 100 can be operated with or without electronic display 110.

In certain implementations, electronic display 110 can be secured to door frame 106 by a latch assembly. For example, one or more of right side brackets 114 can include a latch member that couples with a complementary latch member on mounting block 108 that allows the right side of electronic display assembly 102 to be selectively latched and released from mounting blocks 108.

Figure 15B:
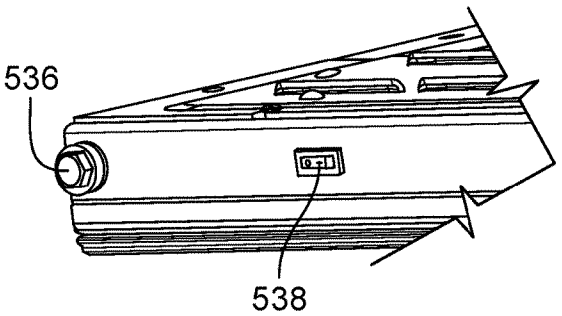
FIGS. 15A and 15B illustrate an exemplary display case door according to implementations of the present disclosure.
Figure 15A:
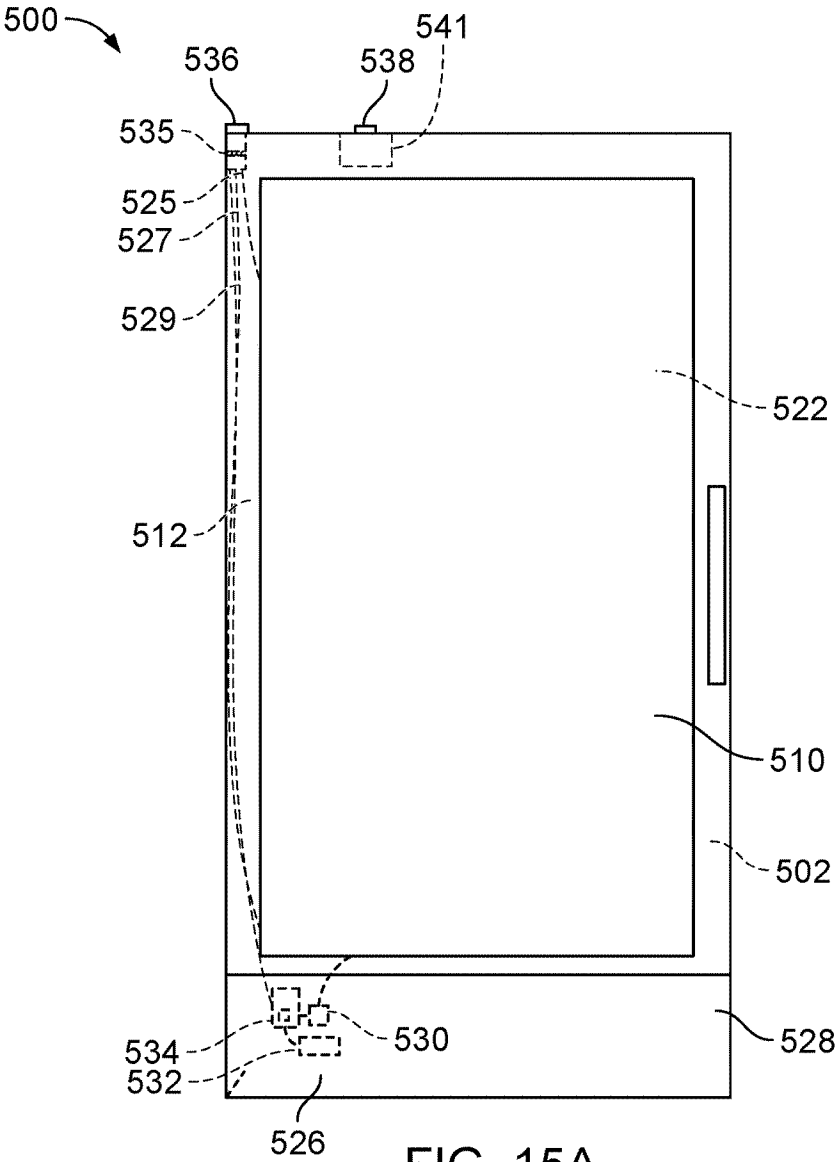

FIG. 15A illustrates an exemplary display case door 500 according to implementations of the present disclosure. Display case door 500 includes quick disconnect plug 535 and a detachable ground lug 536. Quick disconnect plug 535 is electrically coupled to a power cable 525, a ground wire 527, and one or more electrical wires 529 coupled to electronic display 510 or to circuitry module 526. In some implementations, power cable 525 includes at least a power supply cable, a ground cable, and a detachable ground lug in one wiring assembly with one plug on each end of the wiring assembly. For example, the electronic display 510 will have a male component while the door frame 102*b* will have the female component. The male component and the female component can be referred to as a pin and socket connection. The plug will have all the power, ground and neutral joined at the plug.

Similar to the display case door shown in FIGS. 1-14 above, display case door 500 includes a transparent panel assembly 522 and a door frame 502 that receives and secures an electronic display 510 to cover transparent panel assembly 522. Electronic display 510 can be attached to door frame 502 using mounting blocks 108, left side hinge brackets 112, and right side brackets 114 as described in FIGS. 1-14 above. Electronic display 510 has a height that is less than the interior height of door frame 502, leaving a space 528 between the bottom of display case door 500 and the bottom edge of the electronic display 510 to place electrical components with display case door 500. For example, display case door 500 includes circuitry module 526 disposed under the electronic display 510. Circuitry module 526 includes at least a media player 530 in electronic communication with electronic display 510. Media player 530 controls media content presented on electronic display 510. Circuitry module 526 can also include a power hub 532 and a power converter 534. Circuitry module 526 is releasably coupled to door frame 502.

Circuitry module 526 can include one or more quick disconnect plugs 535. A quick disconnect plug 535 is attached to the first end of a control cable. Quick disconnect plug 535 is also attached to a power cable 529. Quick disconnect plug 535 can include a power, audio, visual, or ground wire.

Referring also to FIG. 15B, display case door 500 includes a power switch 538 secured to door frame 512. Power switch 538 is coupled to an electronic device 541 electrically coupled to electronic display 510 to turn on and off the power to electronic display 510. Power switch 538 resides on bottom of door frame 512 and can be in line with power cable 525. Power switch 538 resides on door frame 512 to prevent customers or maintainers from inadvertently cycling power to display case door 500. Power switch 538 can also reside inside circuitry module 526, with a small opening at the bezel cover for a probe to be inserted to actuate power switch 538.

Figure 16A:
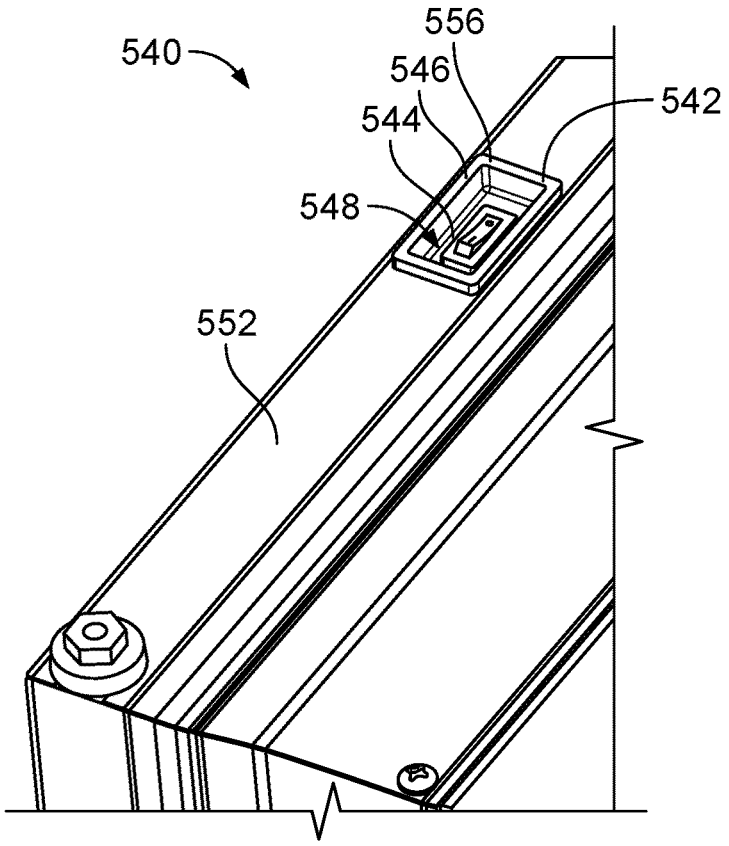
FIG. 16A illustrates an inset power switch on a bottom surface of a display case door.

In some implementations, a power switch for a display case door is inset into the door frame below a bottom surface of the frame. FIG. 16A is a perspective view of a power switch on a bottom surface of a door. The switch assembly 540 can include a molded bezel cover 542 with the power switch 544 inset into the door frame 512. The wires connected to the power switch 544 can be potted to water proof the switch. The molded bezel cover 542 on the power switch 544 can also protect the power switch 544 from damage when installed on the door.

Figure 16B:
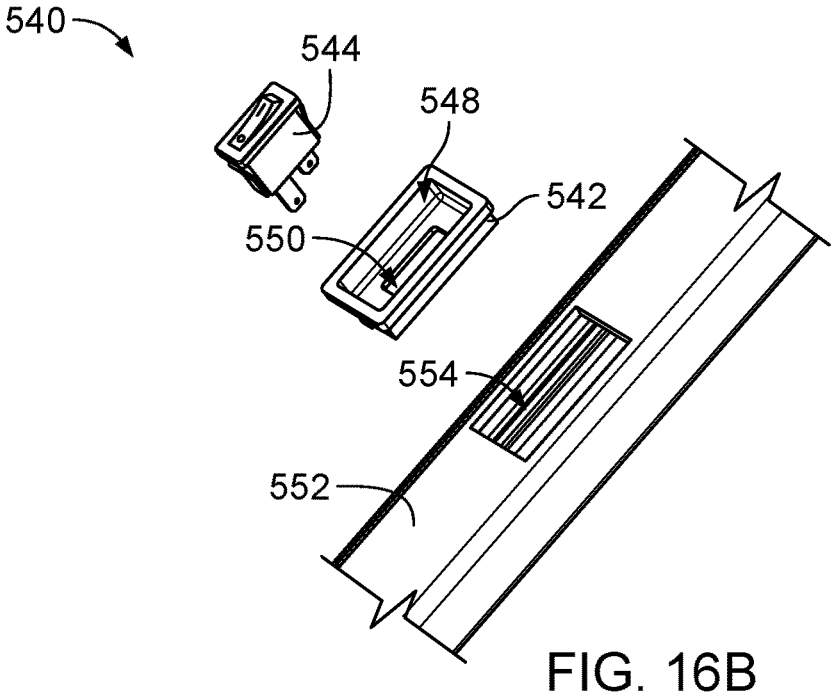
FIG. 16B is an exploded view of the 540 switch assembly of FIG. 16A.

FIG. 16B is an exploded view of the 540 switch assembly of FIG. 16A. Molded bezel cover 542 includes rim 546, pocket 548, and aperture 550. Bottom rail 552 includes opening 554. Molded bezel cover 542 is installed in opening 554. Power switch 544 is installed in aperture 550 of molded bezel cover 542. Power switch 544 can reside in pocket 548. As shown in FIG. 16A, power switch 544 can be recessed relative to the exterior surface 556 of rim 546.

Referring again to FIG. 16A, power cables 525 can provide electrical power to electronic display 510 and power converter 534. Power converter 534 receives alternating current (AC) power from power cable 525 and converts the AC power to direct current (DC) power. For example, power converter 534 converts 110V AC power to 5V DC power. Power converter 534 is electrically connected to one or more media players 530. Power converter 534 is arranged inside display case door 500.

In various implementations described above, a system includes a hinge brackets on a left side of an electronic display assembly and angle brackets on the right side of the electronic display assembly. In other implementations, the hinge bracket can be included on the right side of an electronic display. In still other implementations, a system can include only angle brackets (e.g., with both left and right sides having brackets similar to right side brackets 114), without any hinge brackets. In certain implementations, a system can include brackets on only one side, or include no brackets.

In various implementations described above, mounting blocks for an electronic display are in the form of a plate. Other forms of mounting blocks can be used, however. Other examples of mounting blocks include a bar, a rod, a tube, an angle, or channel.

In various implementations described above, an electronic display assembly includes hangers that be used to support an electronic display a door frame while the electronic display assembly is fastened to a door frame. In other implementations, an electronic display can be supported with other components. For example, a door frame can include a shelf on which an electronic display assembly can be rested while the electronic display assembly is fastened to the door frame (e.g., on a set of mounting blocks such as described above relative to FIGS. 1-14).

Figure 17A:
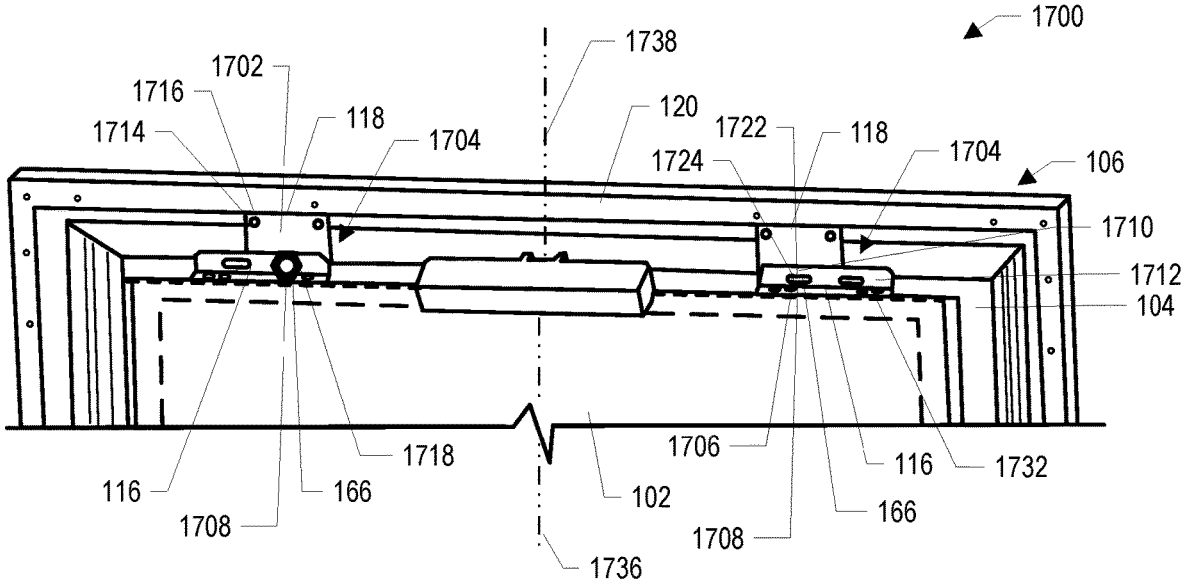
FIGS. 17A and 17B illustrate a support plate and a hanger bracket for an exemplary display case door according to implementations of the present disclosure.
Figure 17B:
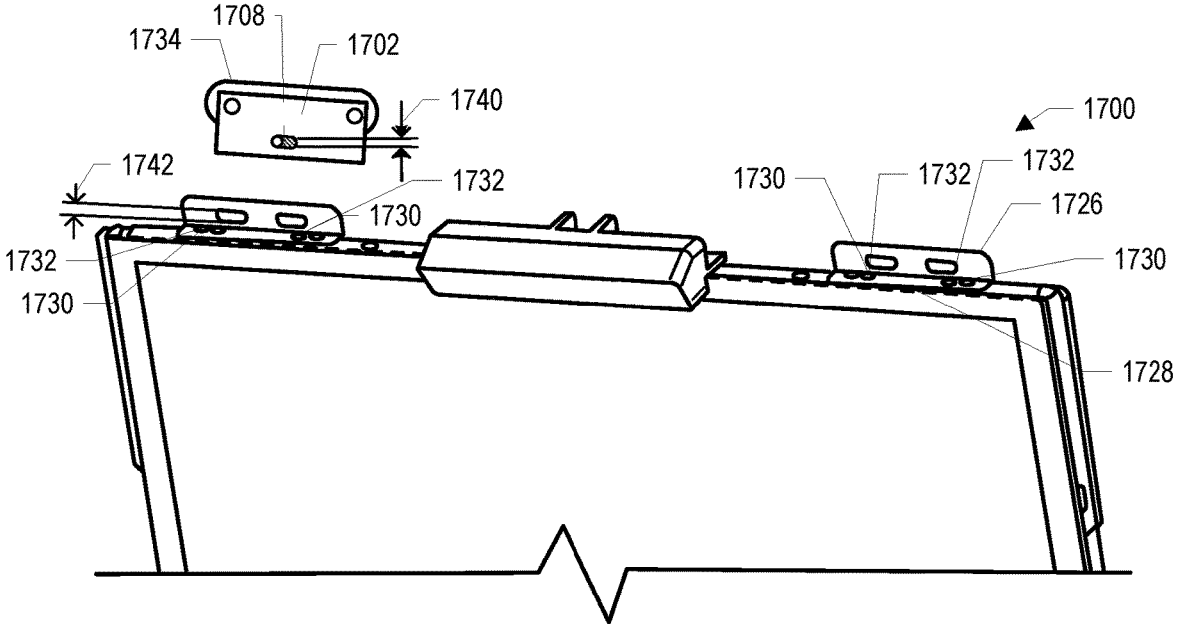

FIGS. 17A and 17B illustrate a support plate and a hanger bracket for an exemplary display case door according to implementations of the present disclosure. The hangers 116 and display supports 118 are generally described previously in reference to FIGS. 5A to 6B. Referring to FIGS. 17A and 17B, display case door 1700 is generally similar to the display case door 100 previously described. The display case door 1700 includes the insulated panel assembly 104, the door frame 106 secured to an edge of the insulated panel assembly 104, and the electronic display assembly 102 coupled to door frame 106 as previously described in reference to FIG. 1. The door frame 106 extends about and is coupled to the insulated panel assembly 104.

The electronic display assembly 102 is coupled to the door frame 106 by the hangers 116, which can also be referred to as a hanger bracket 116, and the display supports 118, which can also be referred to as a support plate 118. The hanger bracket 116 is coupled to electronic display assembly 102 and the support plate 118 is coupled the door frame 106. The hanger bracket 116 couples to the support plate 118 to hang the electronic display assembly 102 in the door frame 106.

The display case door 1700 can include multiple hanger brackets 116 and support plates 118 to hang the electronic display assembly 102 in the door frame 106. The multiple hanger brackets 116 and support plates 118 can be arranged in sets 1704 or pairs. The sets 1704 of hanger brackets 116 and support plates 118 can be horizontally spaced from one another along the top rail 120 of the door frame 106.

The support plate 118 is coupled to the top rail 120 of the door frame 106. The support plate 118 has at least one pin 166, also previously referred to as locating pin 166 in reference to FIGS. 6A and 6B. The pin 166 couples to the hanger bracket 116 to hang the electronic display assembly in the door frame 106. The pin 166 can extend from a surface 1702 of the support plate 118.

The pin 166 can include an outer rim 1706 on an end 1708 of the pin 166. The outer rim 1706 couples to a portion 1710 of a surface 1712 of the hanger bracket 116.

The display case door 1700 can include a fastener 1718 to couple to the pin 166, locking or securing the hanger bracket 116 to the support plate 118. For example, the fastener 1718 can be a bolt, a snap ring, a hair pin, a safety pin, a grip pin, a positive lock pin, a detent pin, a hitch pin, a lynch pin, a bridge pin, a e-clips, a snap rings, an x-ring, a housing ring, a round wire ring, a square wire ring, a rectangular wire ring, a grip ring, a o-ring, a palnut push-on, a self-locking threaded nut, or a cotter pin.

The pin 166 of the support plate 118 has an outer dimension 1740. For example, the outer dimension 1740 of the pin 166 can be ¼ inch, ⅜ inch, 5/16 inch, or ½ inch. The hanger bracket has slots 160 described in more detail below. The slots 160 have an inner dimension 1742. For example, the inner dimension 1742 of the slot 160 can be ¼ inch, ⅜ inch, 5/16 inch, or ½ inch. In some cases, the outer dimension 1740 of the pin 166 is less than the inner dimension 1742 of the slot 160.

The support plate 118 has voids 1714 through which fasteners 1716 pass to couple the support plate 118 to the top rail 120. The fasteners 1716 can be screws, bolts, rivets, or another type of fastener.

The hanger brackets 116 are coupled to the top surface 1720 of the electronic display assembly 102 to at least partially support the electronic display assembly 102 in the door frame 103 by the support plate 118. The hanger brackets 116 have slots 160 which are sized to accept the pin 166. The pin 166 of the support plate 118 passes through the slot 160 of the hanger bracket 116 to position the electronic display assembly 102 relative to the door frame 106. An inner surface 1722 of the slot 160 is coupled to an outer surface 1724 of the pin 166 to hang the electronic display assembly 102 relative to the door frame 106. The electronic display assembly 102 can be positioned relative to the insulated panel assembly 104 by the support plates 118 and the hanging brackets 116 as previously described in reference to FIGS. 13A through 13D.

Referring to FIG. 17B, the hanger bracket 116 has a first portion 1726 and a second portion 1728 orthogonally coupled to the first portion 1726. The slots 160 extend through the first portion 1726. The second portion 1728 couple the hanger bracket 116 to the electronic display assembly 102. As shown in FIGS. 17A and 17B, the second portion 1728 has multiple apertures 1730 sized to accept fasteners 1732 to couple the second portion 1728 of the hanger bracket 116 to the electronic display assembly 102. The fasteners 1732 can be screws, bolts, rivets, or another type of fastener.

The hanger brackets 116 and the support plates 118 hang the electronic display assembly 102 relative to and spaced apart from the insulated panel assembly 104. The electronic display assembly 102 can be uniformly spaced apart from the insulated panel assembly 104 a distance (not shown). For example, the distance separating the electronic display assembly 102 from the insulated panel assembly 104 can be 0.25 inches, 0.2 inches, ⅔ inches, or 1 inch. In some cases, the display case door 1700 includes a spacer 1734 (shown in FIG. 17B) positioned between the support plate 118 and the top rail 120 of the door frame 106 to increase the distance separating the electronic display assembly 102 from the insulated panel assembly 104.

Referring to FIG. 17A, the hanger brackets 116 and the support plates 118 can hang the electronic display assembly 102 relative to the insulated panel assembly 104 such that a longitudinal axis 1736 of the electronic display assembly 102 is aligned (e.g., exactly, substantially, or sufficiently) to a longitudinal axis 1738 of the insulated panel assembly 104.

Referring to FIG. 17A, the hanger brackets 116 can support the electronic display assembly 102 in the door frame 106 such that at least one or more of side brackets 112, 114 coupled to the electronic display assembly 102 are aligned with the corresponding mounting blocks 108 coupled to the door frame. The mounting blocks 108 are previously described in reference to FIGS. 2 through 2B and 4 through 12C.

Figure 18B:
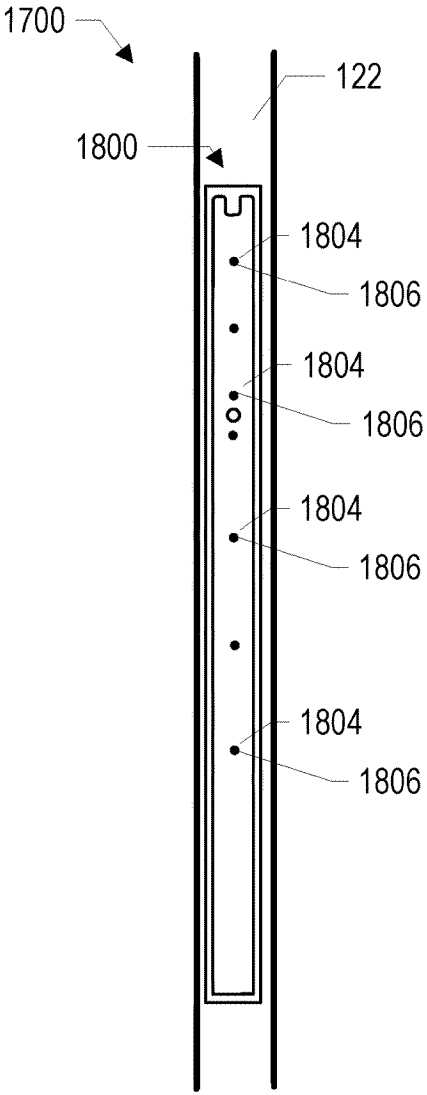
FIGS. 18A and 18B illustrate a stiffener for a display case door according to implementations of the present disclosure.
Figure 18A:
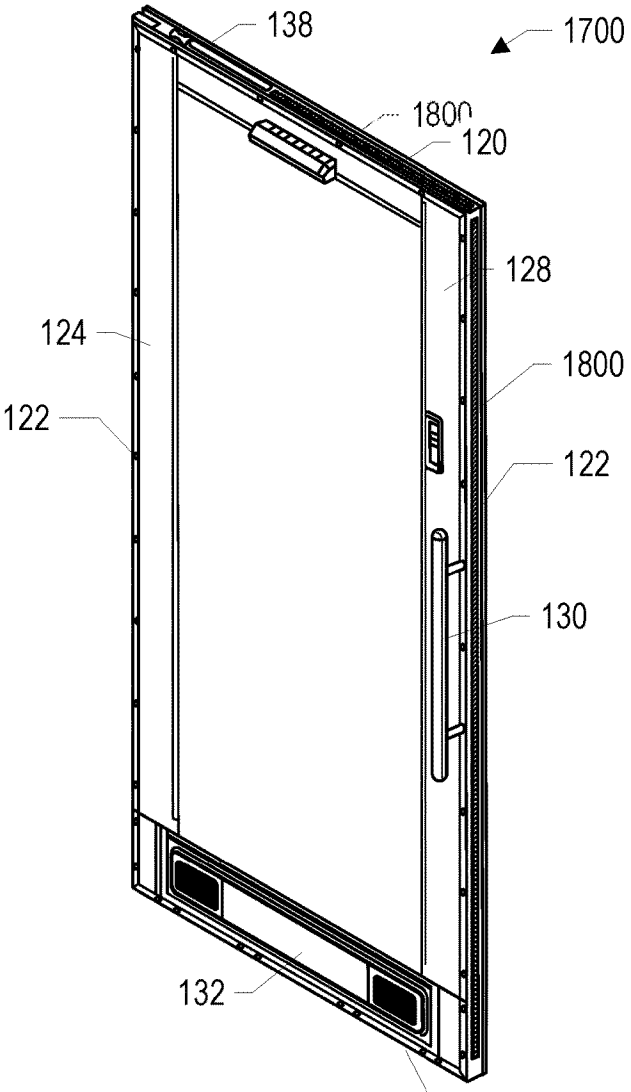

FIGS. 18A and 18B illustrate a stiffener 1800 for the display case door 1700. In some cases, when installing the electronic display assembly 102 on the door frame 106 by the hanger brackets 116 and the support plates 118, or when the display case door 1700 is pushed or pulled with an operating force exceeding a threshold force, one or more of the top rail 120, side rails 122, or bottom rail 1802 bow, causing damage or breakage of the electronic display assembly 102. The stiffener 1800 can be positioned on one or more of the top rail 120, side rails 122, or a bottom rail 1802 to reduce bowing of the electronic display assembly 102. Referring to FIG. 18B, the stiffener 1800 has multiple apertures 1804 sized to accept fasteners 1806 to couple the stiffener 1800 to the electronic display assembly 102. The fasteners 1806 can be screws, bolts, rivets, or another type of fastener. The stiffener 1800 can be a metal, for example, steel, aluminum, or an alloy.

Figure 19:
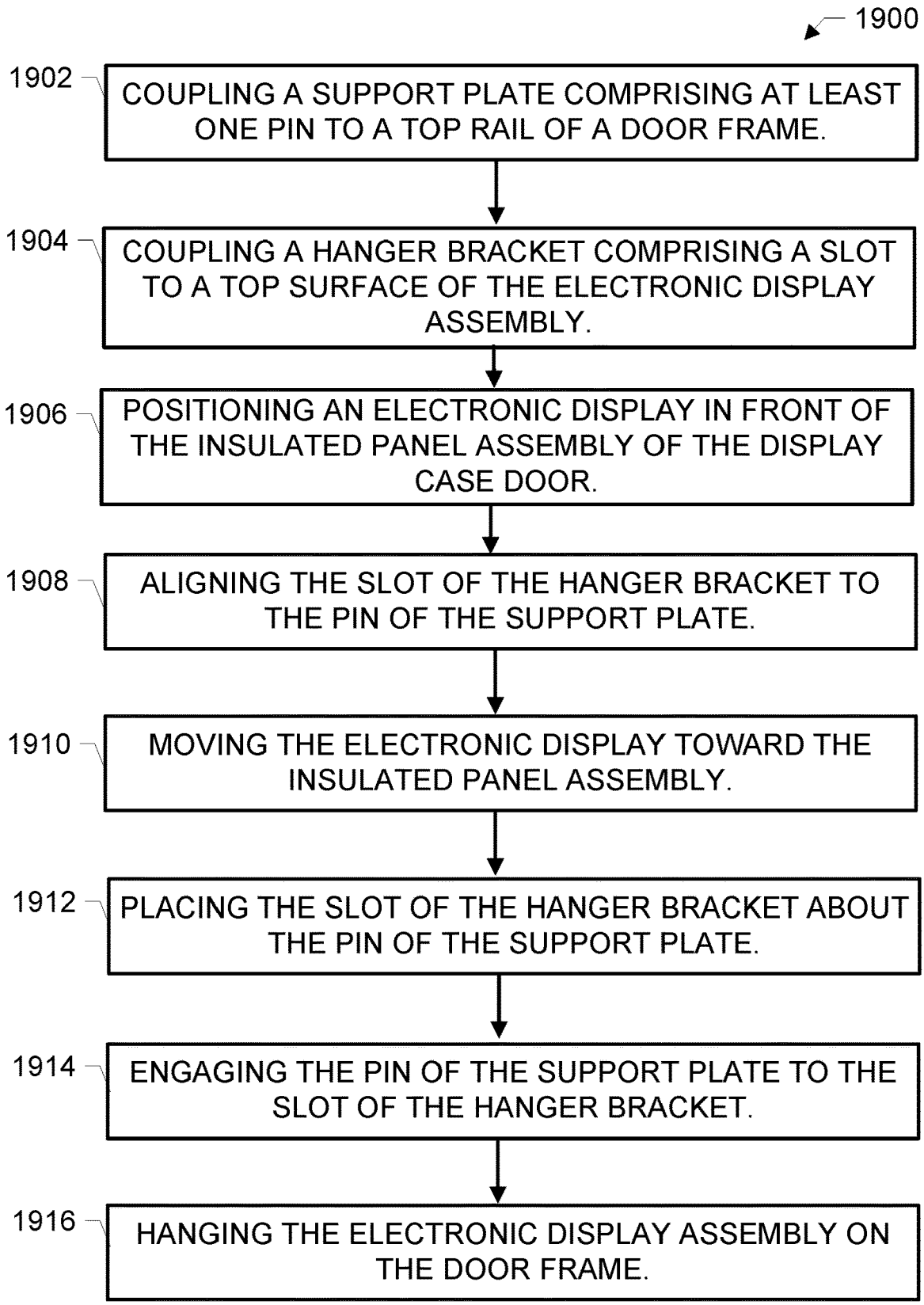
FIG. 19 is a flow chart that describes an example method of installing an electronic display assembly in a display case door comprising an insulated panel assembly according to implementations of the present disclosure.

FIG. 19 is a flow chart that describes an example method 1900 of installing an electronic display assembly 102 in a display case door 100 having an insulated panel assembly 104 according to the present disclosure. Method 1900 can begin at step 1902 which includes coupling a support plate with at least one pin to a top rail of a door frame. For example, the support plate 118 can be coupled to the top rail 120 of the door frame 106 by positioning the support plate 118 on the top rail 120 and passing fasteners 1716 through voids 1714 and into the top rail 120. The fasteners 1716 can be screws, bolts, rivets, or another type of fastener. For example, the pin 166 can extend from the surface 1702 of the support plate 118 to couple to the hanger bracket 116 to hang the electronic display assembly in the door frame 106.

Method 1900 can continue at step 1904, which includes coupling a hanger bracket having a slot to a top surface of the electronic display assembly. For example, the hanger brackets 116 can coupled to the top surface 1720 of the electronic display assembly 102 by passing fasteners 1732 through apertures 1730 in the second portion 1728 of the hanger brackets 116. For example, the slots 160 of the hanger brackets 116 can be sized to accept the pin 166.

Method 1900 can continue at step 1906, which includes positioning an electronic display in front of the insulated panel assembly of the display case door. For example, the electronic display assembly 102 can be lifted by a single person into position such that the electronic display assembly 102 is placed in front of the insulated panel assembly 104 relative to the door frame 106. The electronic display assembly 102 can be positioned relative to the insulated panel assembly 104 such that the longitudinal axis 1736 of the electronic display assembly 102 is aligned (e.g., exactly, substantially, or sufficiently) to the longitudinal axis 1738 of the insulated panel assembly 104.

Method 1900 can continue at step 1908, which includes aligning the slot of the hanger bracket to the pin of the support plate. For example, the electronic display assembly 102 can be lined up such that slots 160 of hanger brackets 116 are lined up with corresponding pins 166 on support brackets 118 attached to top rail 120 of door frame 106.

Method 1900 can continue at step 1910, which includes moving the electronic display toward the insulated panel assembly. For example, referring to FIGS. 13B and 17A, the electronic display assembly 102 can be advanced rearwardly toward insulated panel assembly 104 (in the direction of the arrows of FIG. 13B).

Method 1900 can continue at step 1912, which includes placing the slot of the hanger bracket about the pin of the support plate. For example, referring to FIGS. 13B and 17A, the electronic display assembly 102 can be advanced rearwardly toward insulated panel assembly 104 (in the direction of the arrows of FIG. 13B) until pins 166 on support plates 164 pass through slots 160 of the hanger brackets 116 on electronic display assembly 102.

Method 1900 can continue at step 1914, which includes engaging the pin of the support plate to the slot of the hanger bracket. For example, when the single person release the electronic display assembly 102, no longer laterally supporting the electronic display assembly 102, the pin 166 engages the slot 160.

Method 1900 can continue at step 1916, which includes hanging the electronic display assembly on the door frame. For example, in this position, electronic display assembly 102 can be supported on pin 166.

In some aspects, the steps of method 1900 can include, after step 1916, adjusting a position of the electronic display assembly such that each of one or more side brackets on each side of the electronic display assembly aligns with a corresponding spacer plate inwardly extending from a side rail of the door frame and securing at least one of the one or more side brackets of the electronic display assembly to a corresponding spacer plate such that the electronic display assembly is at least partially supported in the door frame. For example, referring to FIGS. 13C and 17A, the electronic display assembly 102 can be adjusted laterally in either direction (as indicated by the arrows), with slots 160 accommodating movement of pins 166 relative to electronic display assembly 102. The lateral position of electronic display assembly 102 can be adjusted until mounting holes 222 of left side hinge brackets 112 align with threaded mounting holes 194 of mounting blocks 108 on the left side of door frame 106. Slots 160 in hanger brackets 116 allow for lateral adjustment of electronic display assembly 102. As the lateral position of electronic display assembly 102 on display supports 118 is adjusted, electronic display assembly 102 continues to be supported on pins 166 of display supports 118.

In some aspects, the steps of method 1900 can include, prior to positioning the electronic display assembly in front of the insulated panel assembly, coupling a stiffener bar to the electronic display assembly. For example, referring to FIG. 18B, the stiffener 1800 can be positioned on one or more of the top rail 120, side rails 122, or a bottom rail 1802 by fasteners 1806 passing through apertures 1804. The fasteners 1806 can be screws, bolts, rivets, or another type of fastener.

While a number of examples have been described for illustration purposes, the foregoing description is not intended to limit the scope of the invention, which is defined by the scope of the appended claims. There are and will be other examples and modifications within the scope of the following claims. Furthermore, one of skill in the art would appreciate that features described in reference to a specific embodiment are not limited to that embodiment and can be interchanged with features of other embodiments.

What is claimed is:

1. A display case door comprising:

an insulated panel assembly comprising a door frame that extends about and is coupled to the insulated panel assembly;

a support plate coupled to a top rail of the door frame and comprising a least one pin;

an electronic display assembly configured to couple to the door frame; and a hanger bracket coupled to a top surface of the electronic display assembly and comprising a slot sized to accept the pin, the electronic display assembly at least partially supported in the door frame by the support plate and the hanger bracket.

2. The display case door of claim 1, further comprising a spacer plate positioned between the support plate and the top rail.

3. The display case door of claim 1, wherein the pin comprises an outer rim configured to couple to a portion of a surface of the hanger bracket.

4. The display case door of claim 1, wherein the hanger bracket is configured to support the electronic display assembly in the door frame such that at least one of a plurality of side brackets coupled to the electronic display assembly is aligned with at least one of a plurality of corresponding mounting blocks coupled to the door frame.

5. The display case door of claim 1, further comprising a first plurality of fasteners configured to secure the hanger bracket to the support plate.

6. The display case door of claim 1, wherein the hanger bracket comprises two separate hanger brackets horizontally spaced from one another along the top rail of the door frame.

7. The display case door of claim 1, wherein the pin extends from a surface of the support plate.

8. The display case door of claim 1, wherein the support plate comprises voids to accept a second plurality of fasteners configured to couple the support plate to the top rail.

9. The display case door of claim 1, wherein the hanger bracket comprises a first portion and a second portion orthogonally coupled to the first portion, the slot extending through the first portion, the second portion configured to couple the hanger bracket to the electronic display assembly.

10. The display case door of claim 9, wherein the second portion comprises a plurality of apertures, the plurality of apertures sized to accept a third plurality of fasteners configured to couple the second portion of the hanger bracket to the electronic display assembly.

11. The display case door of claim 1, wherein the electronic display assembly hangs relative to and spaced apart from the insulated panel assembly by the support plate.

12. The display case door of claim 11, wherein the electronic display assembly is uniformly spaced apart from the insulated panel assembly.

13. The display case door of claim 1, wherein a longitudinal axis of the electronic display assembly is aligned to a longitudinal axis of the insulated panel assembly based on the hanger bracket being coupled to the support plate.

14. The display case door of claim 1, wherein an outer dimension of the pin is less than an inner dimension of the slot.

15. The display case door of claim 1, further comprising a stiffener bar coupled to the electronic display assembly.

16. An electronic display hanger assembly comprising:

a support plate comprising a least one pin, the support plate configured to couple to a top rail of a door frame of an insulated panel assembly; and a hanger bracket comprising a slot, the hanger bracket coupled to an electronic display assembly, the slot sized to accept the pin, where the electronic display assembly at least partially supported in the door frame by the support plate and the hanger bracket with the support plate mounted to the door frame.

17. The electronic display hanger assembly of claim 16, further comprising a spacer plate configured to be positioned between the support plate and the top rail.

18. The electronic display hanger assembly of claim 16, wherein the pin comprises an outer rim configured to couple to a portion of a surface of the hanger bracket.

19. The electronic display hanger assembly of claim 16, further comprising a first plurality of fasteners configured to secure the hanger bracket to the support plate.

20. The electronic display hanger assembly of claim 16, wherein the hanger bracket comprises two separate hanger brackets horizontally spaced from one another along the top rail of the door frame.

21. The electronic display hanger assembly of claim 16, wherein the pin extends from a surface of the support plate.

22. The electronic display hanger assembly of claim 16, wherein the support plate comprises voids to accept a second plurality of fasteners configured to couple the support plate to the top rail.

23. The electronic display hanger assembly of claim 16, wherein the hanger bracket comprises a first portion and a second portion orthogonally coupled to the first portion, the slot extending through the first portion, the second portion configured to couple the hanger bracket to the electronic display assembly.

24. The electronic display hanger assembly of claim 23, wherein the second portion comprises a plurality of apertures, the plurality of apertures sized to accept a third plurality of fasteners configured to couple the second portion of the hanger bracket to the electronic display assembly.

25. The electronic display hanger assembly of claim 16, wherein an outer dimension of the pin is less than an inner dimension of the slot.

26. A method of installing an electronic display assembly in a display case door comprising an insulated panel assembly, comprising:

coupling a support plate comprising at least one pin to a top rail of a door frame;

coupling a hanger bracket comprising a slot to a top surface of the electronic display assembly;

positioning an electronic display in front of the insulated panel assembly of the display case door;

aligning the slot of the hanger bracket to the pin of the support plate;

moving the electronic display toward the insulated panel assembly;

placing the slot of the hanger bracket about the pin of the support plate;

engaging the pin of the support plate to the slot of the hanger bracket; and hanging the electronic display assembly on the door frame.

27. The method of claim 26, further comprising:

adjusting a position of the electronic display assembly such that each of one or more side brackets on each side of the electronic display assembly aligns with a corresponding spacer plate inwardly extending from a side rail of the door frame; and securing at least one of the one or more side brackets of the electronic display assembly to a corresponding spacer plate such that the electronic display assembly is at least partially supported in the door frame.

28. The method of claim 26, further comprising prior to positioning the electronic display assembly in front of the insulated panel assembly, coupling a stiffener bar to the electronic display assembly.

* * * * *